US006614004B2

(12) United States Patent
Moriya et al.

(10) Patent No.: US 6,614,004 B2
(45) Date of Patent: Sep. 2, 2003

(54) HEATER INCLUDING HEAT DISSIPATION RESISTOR ON SUBSTRATE AND IMAGE HEATING APPARATUS EQUIPPED WITH THE HEATER

(75) Inventors: Shuji Moriya, Ibaraki (JP); Kazuaki Ono, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 84 days.

(21) Appl. No.: 09/903,607

(22) Filed: Jul. 13, 2001

(65) Prior Publication Data

US 2002/0018109 A1 Feb. 14, 2002

(30) Foreign Application Priority Data

Jul. 14, 2000 (JP) ..... 2000-214717
Jul. 14, 2000 (JP) ..... 2000-214718
Jul. 14, 2000 (JP) ..... 2000-214719
Jul. 14, 2000 (JP) ..... 2000-214720

(51) Int. Cl.[7] ..... G03G 15/20
(52) U.S. Cl. ..... 219/216; 399/329; 399/334
(58) Field of Search ..... 219/216, 521, 219/526, 531, 536, 546, 548; 399/328, 329, 334

(56) References Cited

U.S. PATENT DOCUMENTS 5,149,941 A 9/1992 Hirabayashi et al. ..... 219/216
5,575,942 A * 11/1996 Watanabe ..... 219/216
5,682,576 A 10/1997 Sakai et al. ..... 399/69
6,185,383 B1 * 2/2001 Kanari et al. ..... 219/216

FOREIGN PATENT DOCUMENTS

JP 63-313182 12/1988
JP 08328416 * 12/1996
JP 2001244051 * 9/2001

* cited by examiner

*Primary Examiner*—Joseph Pelham
(74) *Attorney, Agent, or Firm*—Fitzpatrick, Cella, Harper & Scinto

(57) ABSTRACT

In a film heating system, since a heating body is in contact with the conductive ring at an end portion of the heating body, heat body through the conductive ring, with the result that the quantity of heat imparted to the object to be heated is uneven inside the nip. This causes low quality of an image since it leads to faulty end-portion fixing, uneven fixing and uneven glossy. In order to solve this problem, a heater capable of suppressing faulty image heating is provided.

18 Claims, 30 Drawing Sheets

HEATER INCLUDING HEAT DISSIPATION RESISTOR ON SUBSTRATE AND IMAGE HEATING APPARATUS EQUIPPED WITH THE HEATER

BACKGROUND OF THE INVENTION

1. Field of the Invention

The present invention relates to a heater to be effectively used in the fixing device of an image forming apparatus, such as a copying machine or a printer, and to an image heating apparatus equipped with this heater.

2. Related Background Art

Conventionally, a heating apparatus (fixing device) using a heat roller fixing system is well known as a heating apparatus for use in an electrophotographic image forming apparatus, such as a copying machine or a laser beam printer.

However, in this system, it is necessary to always maintain high temperature, resulting in large energy consumption, which is contradictory to energy saving. Further, heat emission occurs in the apparatus even during standby, resulting in an increase in the temperature of the interior of the apparatus.

Further, it takes time to heat the roller up to a temperature suitable for heating an object to be heated, such as a paper sheet.

In view of this, Japanese Patent Application Laid-Open No. 63-313182 proposes a method according to which a resistive heat body pattern is provided on an insulating ceramic substrate to form a heater, which is caused to dissipate heat to thereby heat the object to be heated through a thin film.

In this method, the temperature of the heating body rises in a short time, so that if the object to be heated is fed without being warmed up, it is possible to heat up the heater to the desired temperature before the object to be heated in the form of a paper sheet has reached the fixing nip. Further, since no heating is effected during standby, there is no temperature rise in the apparatus, nor is there any energy consumption.

Further, in this film heating fixing type heating apparatus (fixing device), to charge the film surface with a charge of a predetermined polarity, a bias is applied to the film, and a conductive ring which is in contact with an end portion of the film is provided in an end portion of a pressure roller opposed to the heating body with the film therebetween, the bias being applied to the film through the conductive ring.

However, in the film heating fixing system described above, for example, a heating body is in contact with the conductive ring at an end portion of the heating body, so that heat is easily taken away from the end portion of the heating body through the conductive ring, with the result that the quantity of heat imparted to the object to be heated is uneven inside the nip.

Further, when, for example, the factor taking heat away at one end differs from that at the other end in the longitudinal direction, the temperature of the end portion from which more heat is taken away becomes lower than that of the other portion.

This phenomenon adversely affects the image quality when forming an image since it leads to faulty end-portion fixing, uneven fixing, and uneven glossy.

Such a problem occurs not so often when the heat conductivity of the substrate of the heating body is 10 to 30 [W/m·k]. However, when a material whose heat conductivity is higher than that, ranging, for example, from 50 to 150 [W/m·k], is used as the heater substrate, the above problem is particularly likely to occur.

SUMMARY OF THE INVENTION

The present invention has been made in view of the above problems inherent in the prior art. It is accordingly an object of the present invention to provide a heater capable of suppressing faulty image heating, and an image heating apparatus equipped with this heater.

Another object of the present invention is to provide a heater capable of evenly heating an image borne by a recording material, and an image heating apparatus equipped with this heater.

Still another object of the present invention is to provide an image heating apparatus comprising:

a heater for heating an image on a recording material, the heater having a heat dissipation resistor; and a backup member for forming a nip cooperating with the heater, wherein the heat dissipation amount per unit length of the heat dissipation resistor differs between a middle zone and first and second edge zones, and wherein the heat dissipation amount per unit length of said heat dissipation resistor also differs between the first edge zone and the second edge zone.

A further object of the present invention is to provide a heater comprising:

a substrate; and a heat dissipation resistor formed on the substrate, wherein the heat dissipation amount per unit length of the heat dissipation resistor differs between a middle zone and first and second edge zones, and wherein the heat dissipation amount per unit length of said heat dissipation resistor also differs between the first edge zone and the second edge zone.

A further object of the present invention is to provide an image heating apparatus comprising:

a heater for heating an image on a recording material, the heater having a heat dissipation resistor; and a backup member for forming a nip cooperating with the heater, wherein the heat dissipation resistor has a uniform heat dissipation amount per unit length in the longitudinal direction, and is divided into a left zone and a right zone differing in length with respect to a conveyance reference for the recording material.

A further object of the present invention is to provide a heater comprising:

a substrate; and a heat dissipation resistor formed on said substrate, wherein said heat dissipation resistor has a uniform heat dissipation amount per unit length in the longitudinal direction, and is divided into a left zone and a right zone differing in length with respect to a conveyance reference for a recording material.

A further object of the present invention is to provide an image heating apparatus comprising:

a heater for heating an image on a recording material, the heater having a heat dissipation resistor; and a backup member for forming a nip cooperating with the heater, wherein the heat dissipation amount per unit length of said heat dissipation resistor differs between a middle zone and first and second edge zones, and wherein the first edge zone and the second edge zone differ in length.

A further object of the present invention is to provide a heater comprising:

a substrate; and a heat dissipation resistor formed on the substrate, wherein the heat dissipation amount per unit length of the heat dissipation resistor differs between a middle zone and first and second edge zones, and wherein the first edge zone and the second edge zone differ in length.

A further object of the present invention is to provide an image heating apparatus comprising:

a heater for heating an image on a recording material, the heater having a heat dissipation resistor;

a supporting member for supporting the heater; and a backup member for forming a nip cooperating with the heater, wherein the supporting member has a heat insulating means at a position corresponding to at least one of first and second edge zones of said heat dissipation resistor.

Further objects of the present invention will become apparent from the following detailed description made with reference to the accompanying drawings.

BRIEF DESCRIPTION OF THE DRAWINGS

FIG. 1A is a view of a heater as seen from the nip side, and FIG. 1B is a front view of the heater.

FIG. 2A is a view of a heater as seen from the nip side, and FIG. 2B is a front view of the heater.

FIG. 3A is a view of a heater as seen from the nip side, and FIG. 3B is a front view of the heater.

FIG. 4A is a view of a heater as seen from the nip side, and FIG. 4B is a front view of the heater.

FIG. 8A is a view of a heater as seen from the nip side, and FIG. 8B is a front view of the heater.

FIG. 9A is a view of a heater as seen from the nip side, and FIG. 9B is a front view of the heater.

FIG. 10A is a view of a heater as seen from the nip side, and FIG. 10B is a front view of the heater.

FIG. 11A is a view of a heater as seen from the nip side, and FIG. 11B is a front view of the heater.

FIG. 12A is a view of a heater as seen from the nip side, and FIG. 12B is a front view of the heater.

FIG. 13A is a view of a heater as seen from the nip side, and FIG. 13B is a front view of the heater.

FIG. 15A is a view of a heater as seen from the nip side, and FIG. 15B is a front view of the heater.

FIG. 16A is a view of a heater as seen from the nip side, and FIG. 16B is a front view of the heater.

FIG. 17A is a view of a heater as seen from the nip side, and FIG. 17B is a front view of the heater.

FIG. 18A is a view of a heater as seen from the nip side, and FIG. 18B is a front view of the heater.

FIG. 19A is a view of a heater as seen from the nip side, and FIG. 19B is a front view of the heater.

FIG. 20A is a plan view of a heater substrate, FIG. 20B is a plan view of a stay, and FIG. 20C is a front view of the fixing device.

FIGS. 21A, 21B and 21 C are schematic diagrams showing a fixing device according to a fifteenth embodiment. FIG. 21A is a plan view of a heater substrate, FIG. 21B is a plan view of a stay, and FIG. 21C is a front view of the fixing device.

FIG. 22A is a plan view of a heater substrate, FIG. 22B is a plan view of a stay, and FIG. 22C is a front view of the fixing device.

FIG. 23A is a plan view of a heater substrate, FIG. 23B is a plan view of a stay, and FIG. 23C is a front view of the fixing device.

FIG. 26A is a schematic view of a heater, and FIG. 26B is a front view of a fixing device.

DETAILED DESCRIPTION OF THE PREFERRED EMBODIMENTS

Embodiments of the present invention will now be described with reference to the drawings.

First Embodiment

Figures 1A, 1B:
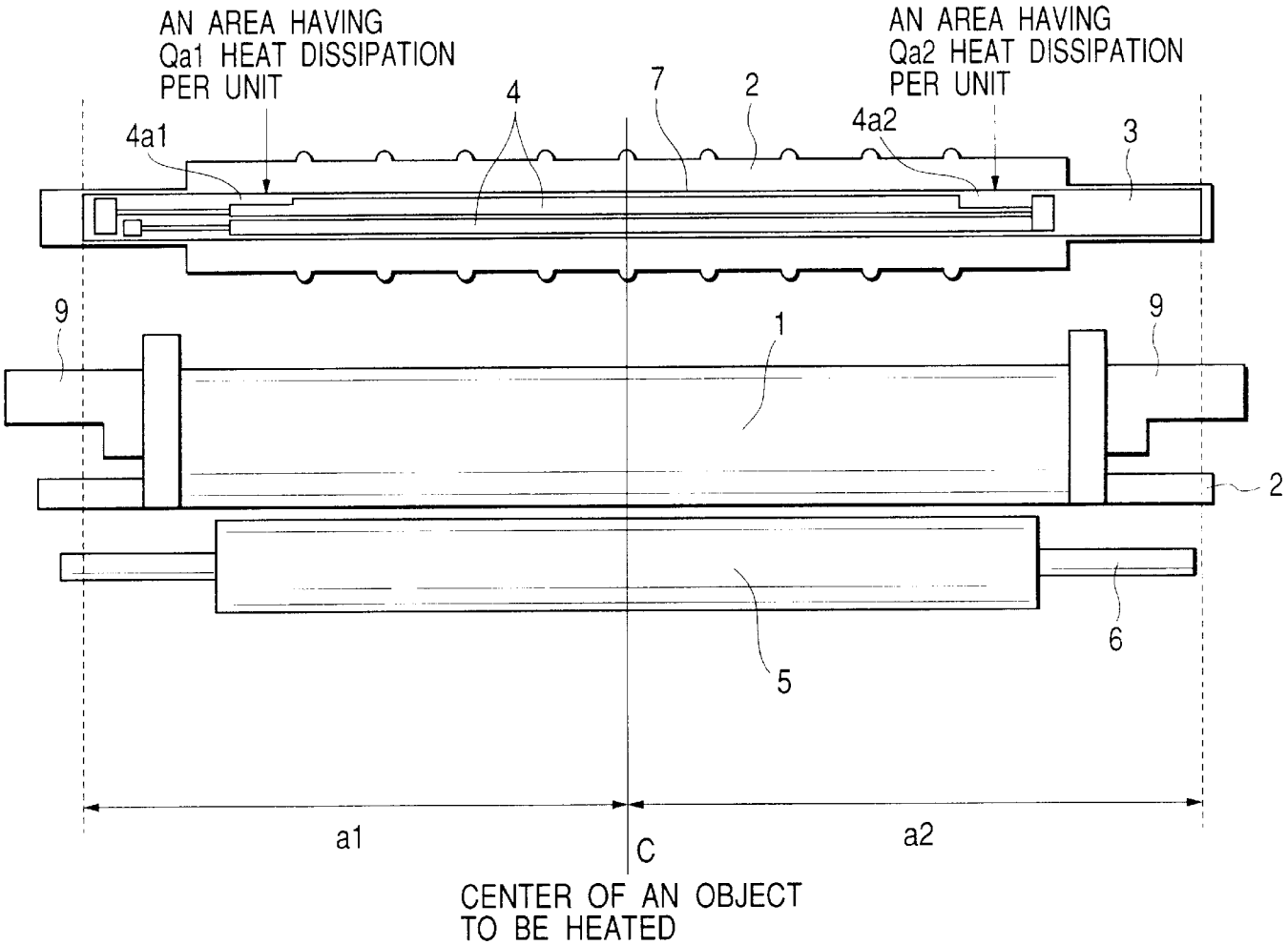
FIGS. 1A and 1B are schematic diagrams showing a fixing device according to a first embodiment.

FIGS. 1A and 1B show a first embodiment of the present invention.

In this embodiment, the present invention is applied to a fixing device serving as a heating apparatus used in a laser beam printer serving as an example of an image forming apparatus. A recording paper sheet which constitutes an object to be heated is conveyed while using a central position C in FIGS. 1A and 1B as a reference.

In this embodiment, the distance from the conveyance center C of the object to be heated to the left end of the heater substrate 3 differs from the distance from the conveyance center C of the object to be heated to the right end of the heater substrate 3.

FIG. 1A is a schematic view, as seen from the nip side, of a stay 2 which also serves as a heater holder and to which a heater 7 is attached, and FIG. 1B is a schematic view showing the positional relationship between the heater unit to which the stay 2 is attached and a pressure roller 5, as seen from the direction in which the object to be heated advances.

The heater 7 is formed by applying to the surface of the heater substrate 3 formed of alumina or the like an electrically resistive material, such as Ag/Pd (silver-palladium), by screen printing or the like, to a thickness of approximately 10 $\mu$m and in a width of 13 mm, and providing thereon a coating of glass, fluororesin or the like serving as a protecting film. The thermal conductivity of the heater substrate 3 is 50 to 150 [W/m·k].

And, a temperature control device (not shown) performs control such that a fixed temperature is maintained in the paper conveyance area.

The stay 2 is formed by the molding of a heat resisting resin, such as PPS, liquid crystal polymer, or phenol resin. To achieve a reduction in heat capacity and an improvement in terms of quickness in starting, the film 1 is formed into a total thickness of not more than 100 $\mu$m, more preferably, not more than 40 $\mu$m and not less than 20 $\mu$m, using a single layer film of PTFE, PFA, FEP or the like, which excels in heat resistance, mold releasing property, strength, durability, etc., or a composite layer film formed by providing a coating of PTFE, PFA, FEP or the like on the outer peripheral surface of a layer of polyimide, polyamide imide, PEEK, PES, PPS or the like.

Figure 7:
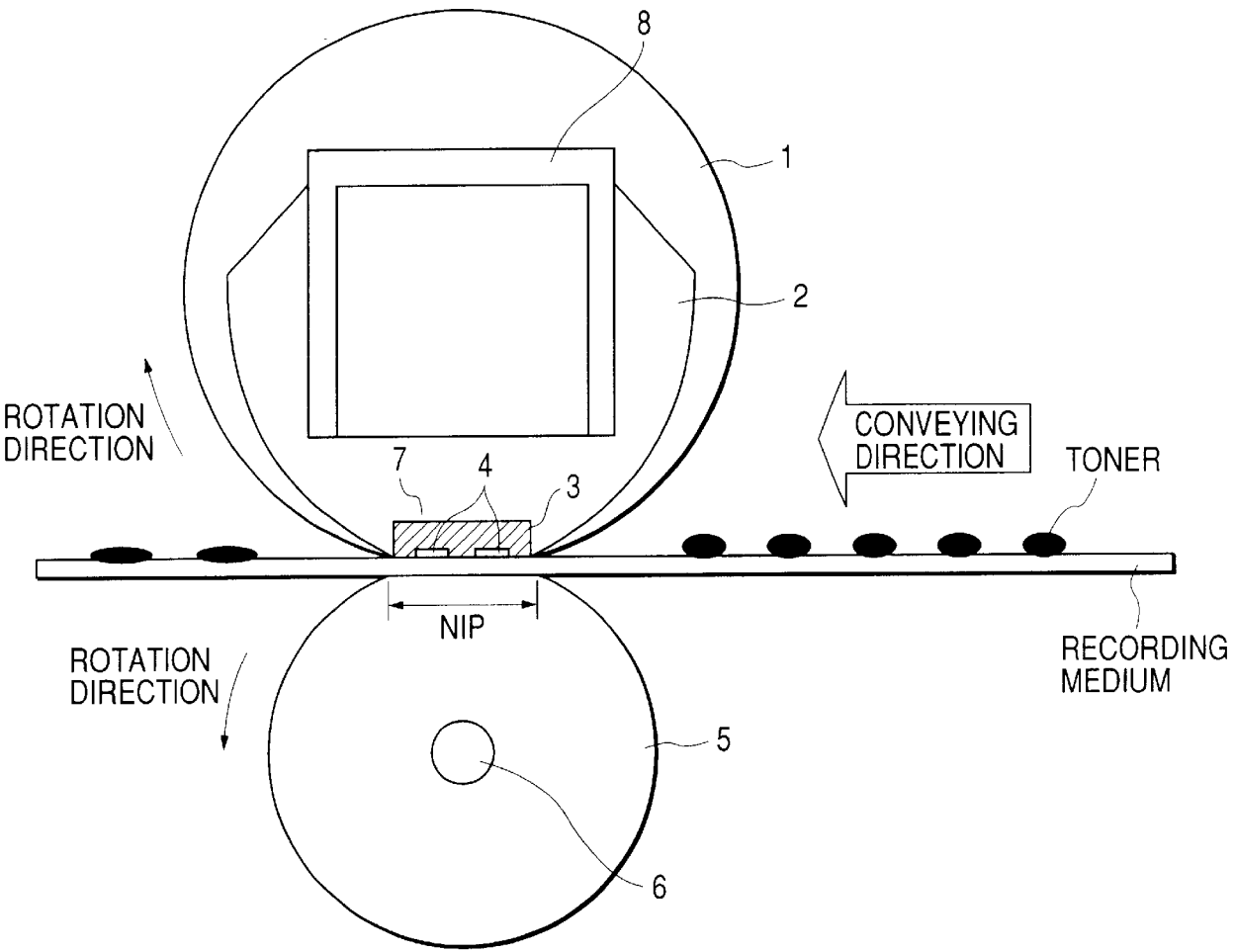
FIG. 7 is a schematic sectional view of a fixing device.

FIG. 7 is a sectional view of the central portion of a fixing device, showing how a recording material and toner thereon are heated in a press contact nip portion of a heating apparatus (fixing device).

As shown in FIGS. 1A and 1B, the width of each of left and right end portions 4*a*1 and 4*a*2 of resistive heat bodies 4 is smaller than the width of the central portion thereof. While the length of each of the left and right narrow portions at the ends is the same, the width of the right end portion 4*a*2 is smaller than that of the left end portion 4*a*1, the longitudinal heat dissipation amount per unit length in the left and right end portions 4*a*1 and 4*a*2 being larger than that in the central portion.

In this embodiment, assuming that the left-hand side length as measured from the longitudinal center C serving as the conveyance reference for the object to be heated to the left end of the heater substrate 3 is a1, and that the right-hand side length as measured from the center C to the right end of the heater substrate is a2, a1 is smaller than a2, so that it is to be assumed that the quantity of heat flowing out of the resistive heat bodies 4 is relatively large on the right-hand side. Thus, when the distance from the center of the object to be heated to the right end of the resistive heat bodies 4 is the same as that from the center of the object to the left end of the resistive heat bodies 4, a relatively poor fixing property is to be expected in the vicinity of the right end portion.

To cope with this, the longitudinal heat dissipation amount per unit length around the right end portion 4*a*2 of each resistive heat bodies 4 is made larger than that around the left end portion 4*a*1 thereof. Assuming that the longitudinal heat dissipation amount per unit length in the vicinity of the left end portion 4*a*1 with respect to the center C of the object to be heated is Qa1, and that the longitudinal heat dissipation amount per unit length in the vicinity of the right end portion 4*a*2 is Qa2, the following relationship is established: Qa1<Qa2. The unit of Qa1 and Qa2 is [J/s·m], [cal/s·m] or the like.

Second Embodiment

Figures 2A, 2B:
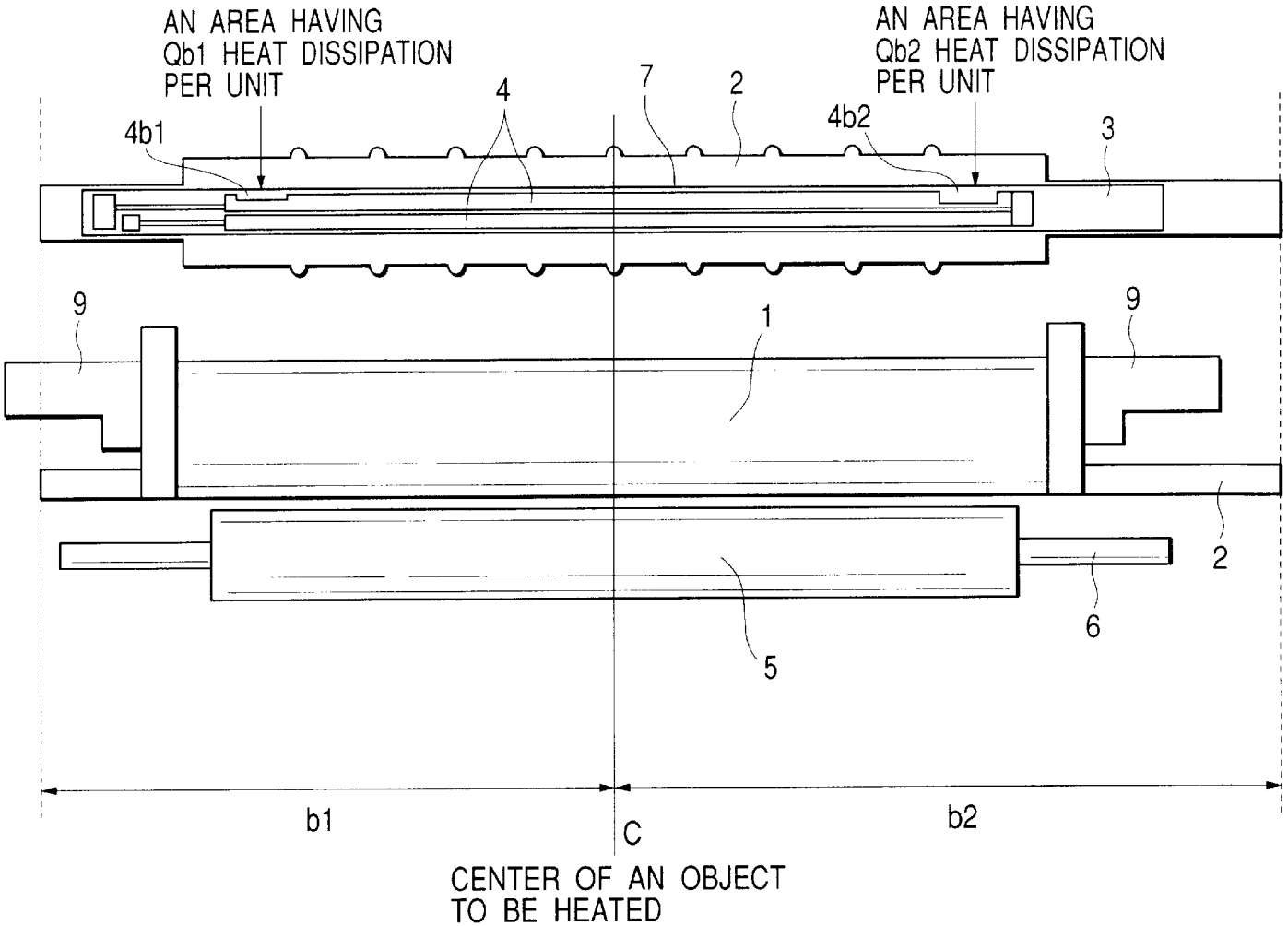
FIGS. 2A and 2B are schematic diagrams showing a fixing device according to a third embodiment.

FIGS. 2A and 2B show a second embodiment of the present invention.

In this embodiment, the distance from the center C of the object to be heated to the right end of the stay 2 is different from the distance from the center C to the left end of the stay 2.

FIGS. 2A and 2B are schematic diagrams similar to that showing the first embodiment. In the first embodiment the respective distances from the center C of the object to be heated to the right and left ends of the heater substrate 3 are different. By contrast, in the second embodiment shown in FIGS. 2A and 2B, while the respective distances from the center C of the object to be heated to the right and left ends of the heater substrate 3 are the same, it is to be noted that b1<b2 in this case, where b1 is the length to the left end of the stay 2, and b2 is the length to the right end thereof, so that it is to be assumed that the quantity of heat flowing out of the resistive heat bodies 4 is larger on the right-hand side since the length of the stay 2 is larger on this side.

In this case also, for the same reason as that in the first embodiment, the longitudinal heat dissipation amount per unit length in the vicinity of the end portions of the resistive heat bodies 4 is larger on the right-hand side, where the quantity of heat flowing out is assumed to be larger (Qb1<Qb2).

It is to be noted that, unlike the first embodiment shown in FIGS. 1A and 1B, the second embodiment shown in FIGS. 2A and 2B has cutouts 4*b*1 and 4*b*2, having the same length and different widths, formed at positions somewhat inwardly spaced apart from the right and left ends of the resistive heat bodies 4, and the portions where the heat dissipation amount per unit length is larger than in the central portion are not the extreme ends but the portions somewhat inwardly offset therefrom. The line width of the resistive heat body in the left-hand cutout 4*b*1 is larger than the line width thereof in the right-hand cutout 4*b*2.

Third Embodiment

Figures 3A, 3B:
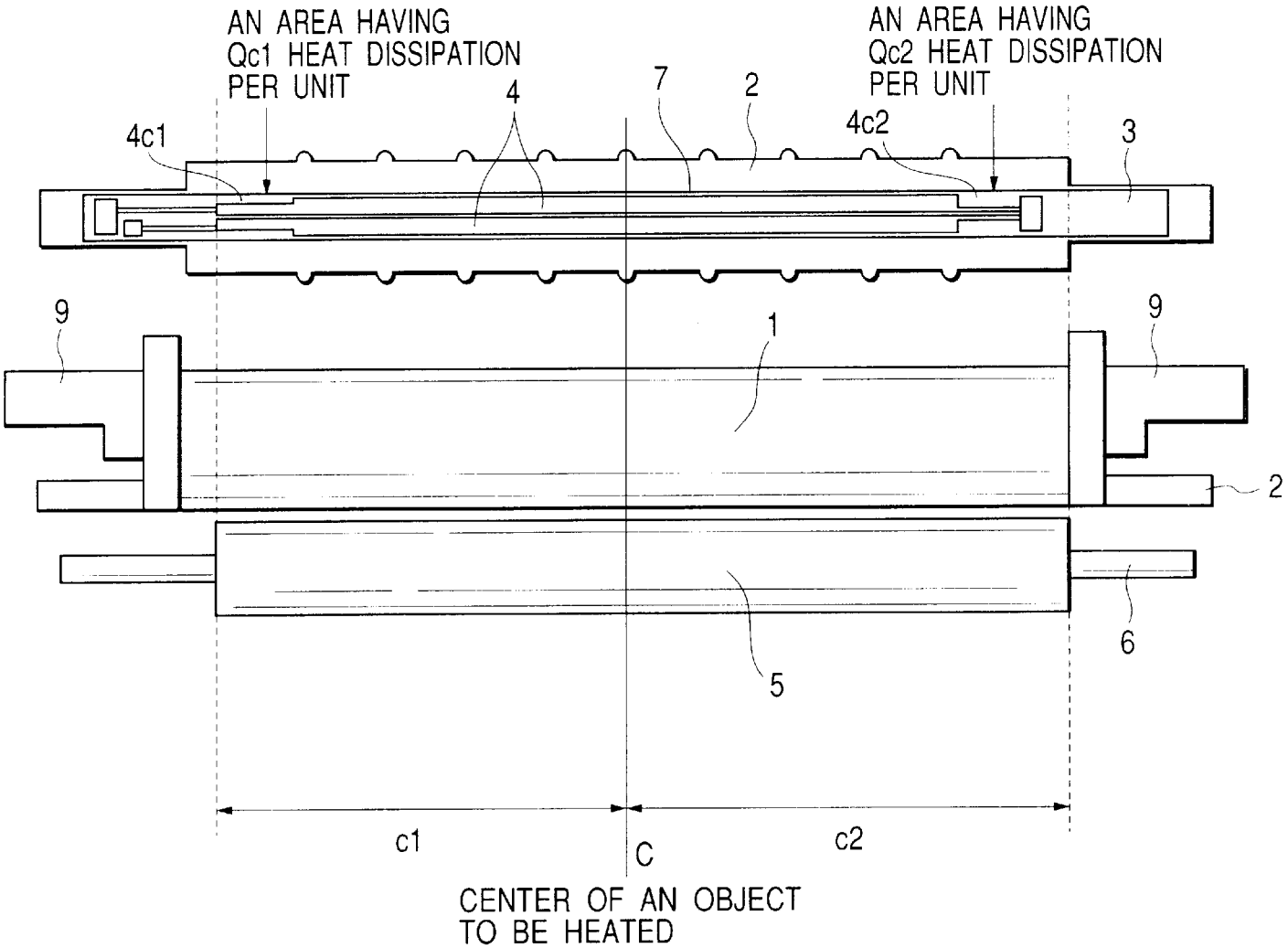
FIGS. 3A and 3B are schematic diagrams showing a fixing device according to a fourth embodiment.

FIGS. 3A and 3B show a third embodiment.

In this embodiment, the respective distances from the center C of the object to be heated to the right and left ends of the pressure roller 5 are different.

FIGS. 3A and 3B are schematic diagrams similar to FIGS. 1A and 1B showing the first embodiment. The portions of the pressure roller 5 in the vicinity of its ends are in contact with the portions of the heater substrate 3 where there are no resistive heat bodies 4. Further, since the pressure roller 5 rotates, with its surface being in contact with air while constantly moving at a speed, it is easily cooled. Thus, a large quantity of heat is likely to escape to the end portions of the pressure roller 5 from the end portions of the resistive heat bodies 4 through the heater substrate 3.

As shown in FIGS. 3A and 3B, in this embodiment, assuming that the respective distances from the center C of the object to be heated to the left and right ends of the pressure roller 5 are C1 and C2, respectively, the following relationship is established: C1<C2. As in the above-described embodiment, in this case also, heat is more likely to flow out of heat body on the right-hand side since the length of the pressure roller 5 is larger on this side. Thus, it is necessary to make the heat dissipation amount per unit length in the vicinity of the right-hand end 4*c*2 of the resistive heat bodies 4 larger than that in the vicinity of the left-hand end 4*c*1 thereof to impart heat uniformly to the object to be heated inside the nip.

In view of this, assuming that the longitudinal heat dissipations per unit in the vicinity of the left and right end portions 4*c*1 and 4*c*2 of the resistive heat bodies 4 are Qc1 and Qc2, respectively, the following relationship is established: Qc1<Qc2.

As shown in FIGS. 3A and 3B, in this embodiment, in the vicinity of the left and right end portions 4*c*1 and 4*c*2 of the resistive heat bodies 4, portions where the heat dissipation amount per unit length is larger than in the central portion are provided in both of the two resistive heat bodies arranged side by side, and the line width of the right end portion 4*c*2 is smaller than the line width of the left end portion 4*c*1, making the heat dissipation amount per unit length larger on the right-hand side.

Figures 8A, 8B:
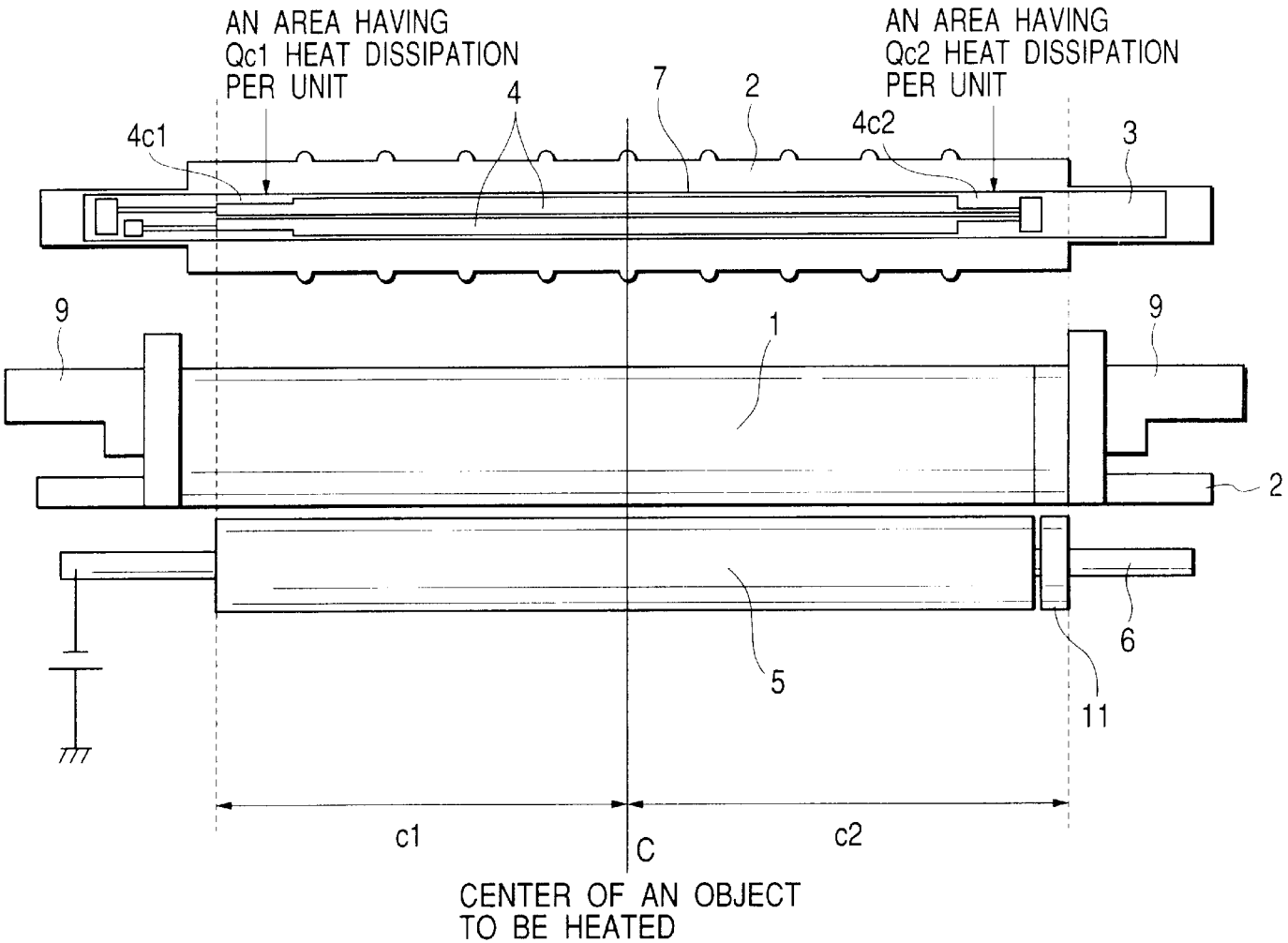
FIGS. 8A and 8B are schematic diagrams showing an example of the case in which a film biasing ring is used.

As shown in FIGS. 8A and 8B, when attaching a ring 11 formed of a conductive rubber or the like to an end portion of the pressure roller 5 to apply a bias to the film through a core bar 6 of the pressure roller 5, the ring 11 has substantially the same diameter as the pressure roller 5 and it is to be assumed that heat comes from the film 1 even if it is not in contact with the pressure roller 5. Thus, it is to be regarded as a part of the pressure roller 5. Then, it is possible to uniformly heat the object to be heated by making the longitudinal heat dissipations per unit in the vicinity of the left and right end portions of the resistive heat bodies 4 different as in this embodiment.

Fourth Embodiment

Figures 4A, 4B:
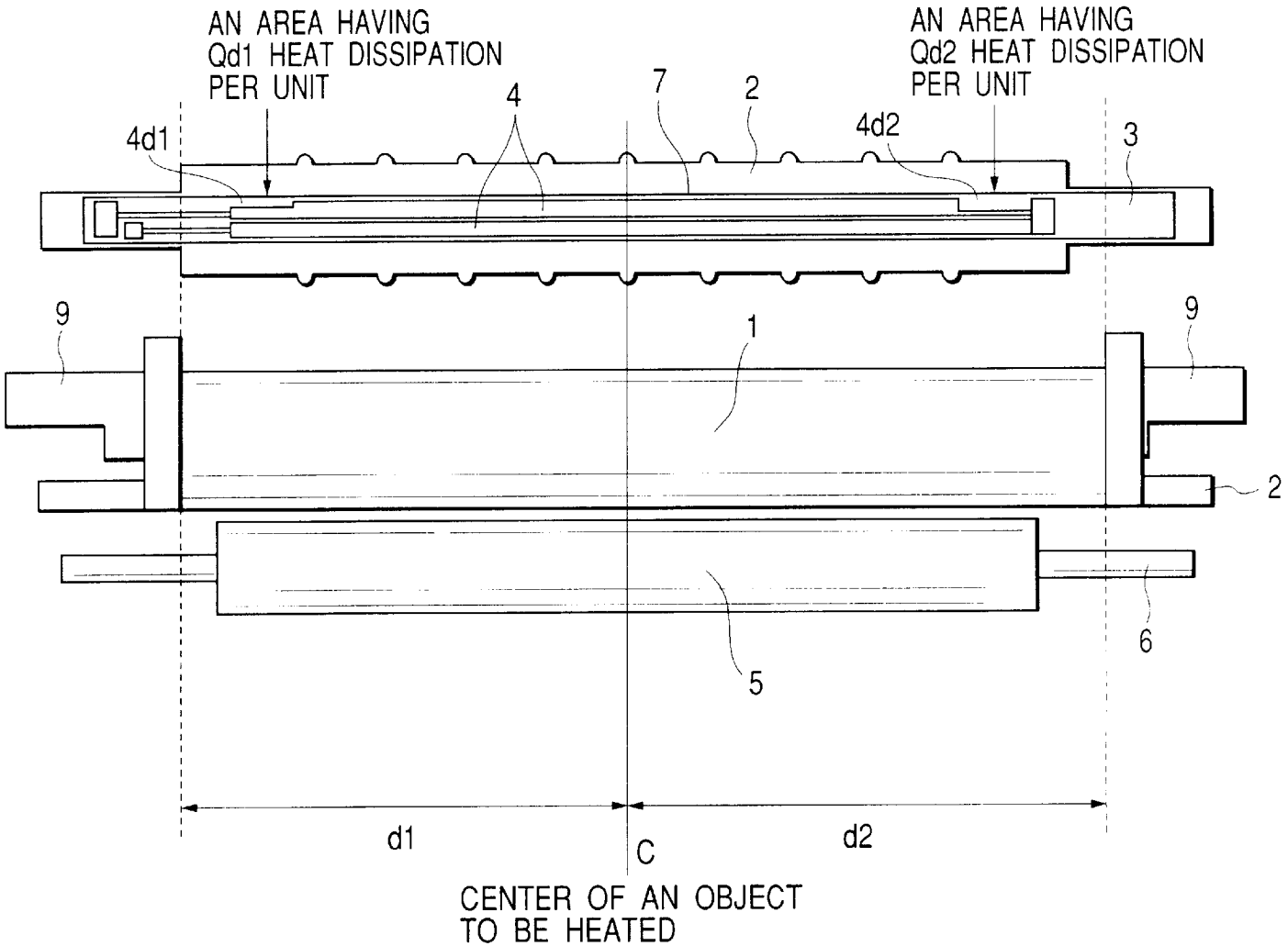
FIGS. 4A and 4B are schematic diagrams showing a fixing device according to a fourth embodiment.

FIGS. 4A and 4B show a fourth embodiment of the present invention.

In this embodiment, the respective distances from the center C of the object to be heated to the left and right ends of the film 1 are different.

FIGS. 4A and 4B are schematic diagrams similar to the one showing the first embodiment. This construction is adopted when using a flange 9 whose right and left end portions are different. The end portions of the film 1 are in contact with the portions of the heater substrate 3 where there are no resistive heat bodies 4.

Further, the film 1 rotates, and its surface is in contact with air while constantly moving at a speed, so that it is easily cooled.

Thus, a large quantity of heat is likely to escape from the end portions of the resistive heat bodies 4 to the end portions of the film 1 through the heater substrate 3.

As shown in FIGS. 4A and 4B, assuming that the respective distances from the center C of the object to be heated to the left and right ends of the film 1 are d1 and d2, the following relationship is established: d1<d2. In this case, heat is likely to be taken by the film 1, and the temperature in the vicinity of the nip inner end portion on the right-hand side is lower than in the other portion.

In view of this, the line width of the right end portion 4*d*2 of the resistive heat bodies 4 with respect to the center C of the object to be heated is made smaller than the line width of the left end portion 4*d*1, so that the longitudinal heat dissipation amount per unit length in the vicinity of the right end portion 4*d*2 is larger than that in the vicinity of the left end portion, thereby uniformly imparting heat to the object to be heated inside the nip.

Assuming that the longitudinal heat dissipations per unit in the vicinity of the left and right end portions 4*d*1 and 4*d*2 are Qd1 and Qd2, respectively, the following relationship is established: Qd1<Qd2.

Fifth Embodiment

Figure 5:
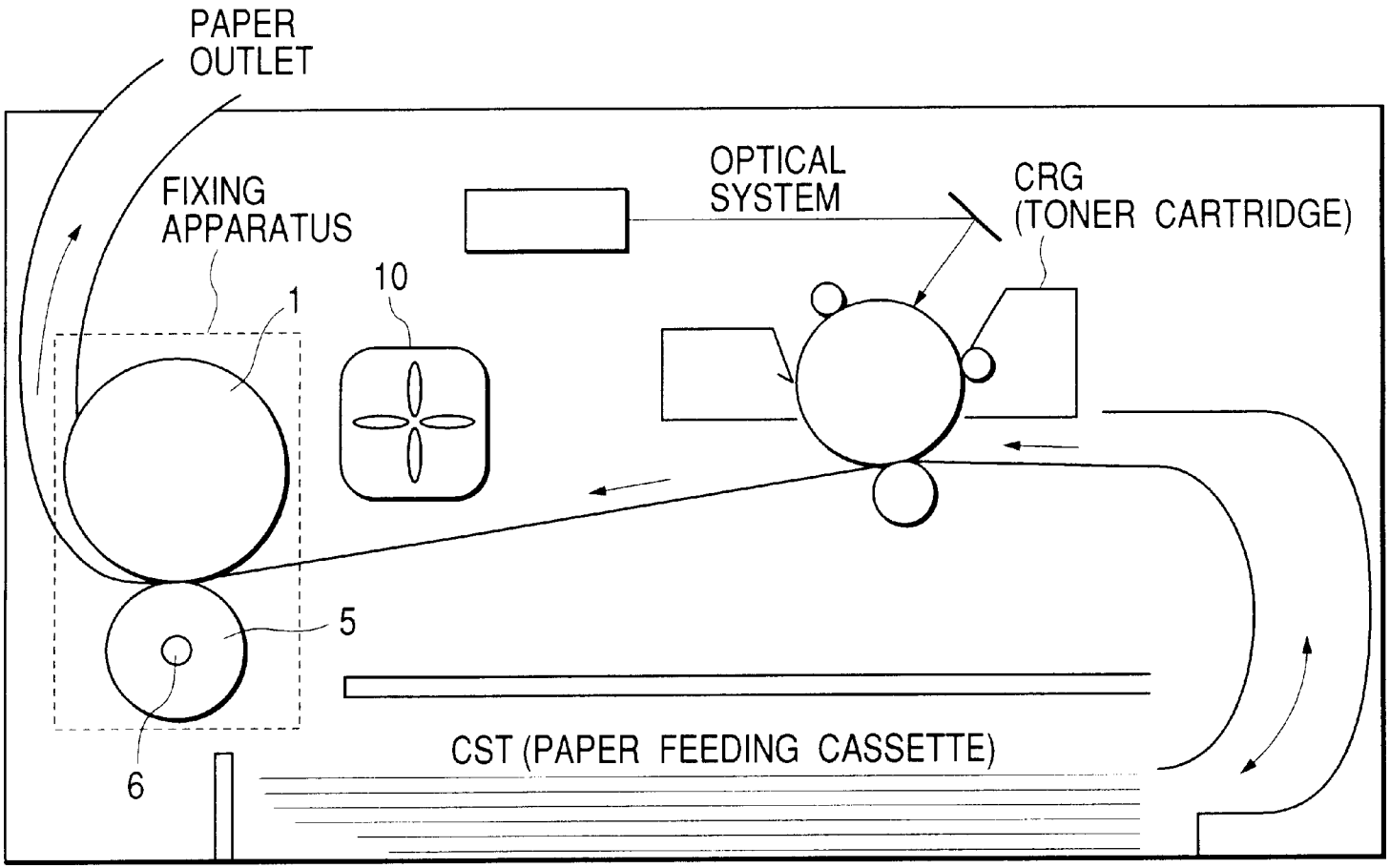
FIG. 5 is a schematic diagram showing a fixing device according to a fifth embodiment.
Figure 6:
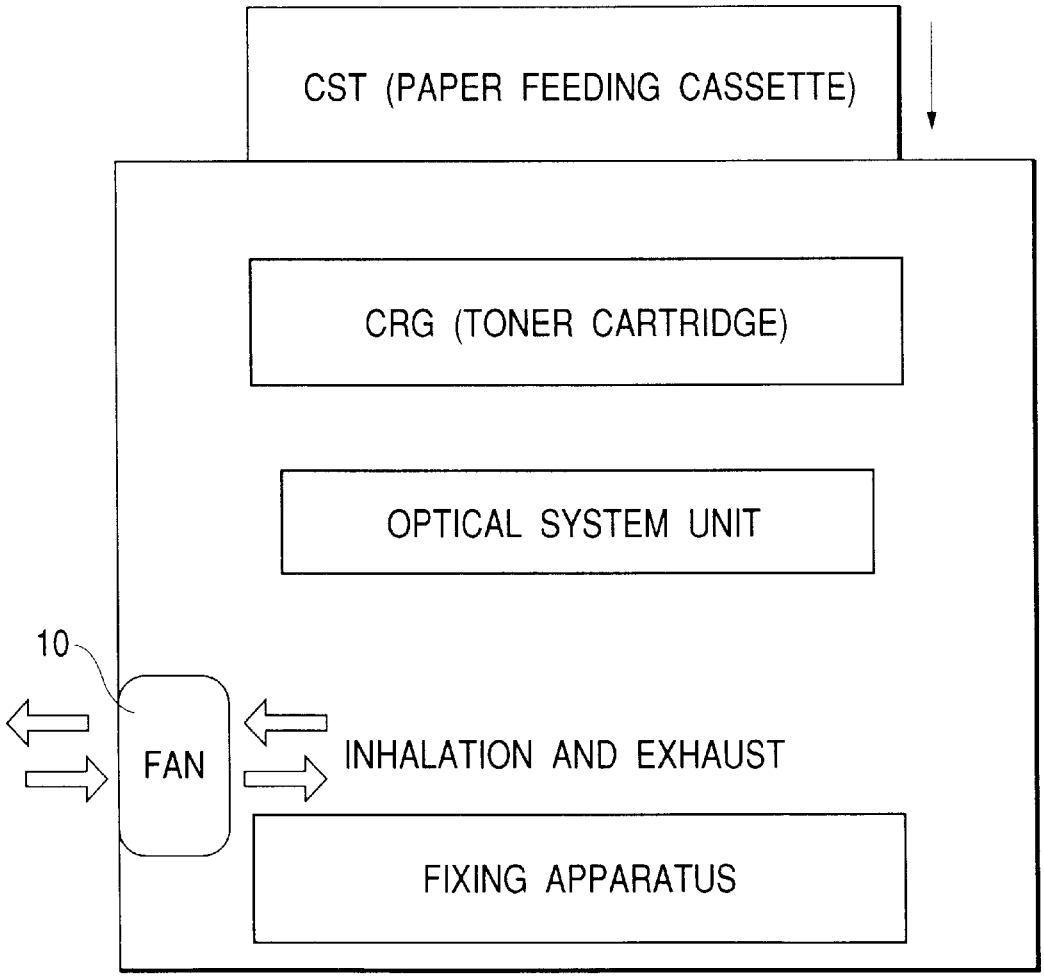
FIG. 6 is a schematic diagram showing the fixing device according to the fifth embodiment.

FIGS. 5 and 6 show a fifth embodiment of the present invention.

A case will be described in which a fan 10 is mounted either to the left or to the right with respect to the center line of the object to be heated. In the case of a laser beam printer, for example, the fan 10 is usually mounted either to the right or to the left with respect to the center line C of the object to be heated for the purpose of preventing a rise in-apparatus temperature and a rise in-apparatus humidity.

FIG. 5 is a cross-sectional view of a laser beam printer. The fan 10 is mounted somewhat upstream of the fixing device. FIG. 6 is a conceptual representation of the construction as seen from above. Regardless of whether the fan 10 is performing in-take operation or exhaust operation, the ambient temperature of the portion of the fixing device near the fan 10 tends to be low, which allows easy escape of heat. Thus, even if there is no difference in the way heat escapes between the right and left sides of the fixing device, there is the possibility of the influence of the fan 10 being exerted on one side of the center of the object to be heated.

As in the above-described embodiments, in this case also, by making the longitudinal heat dissipation amount per unit length in the vicinity of the right end portion of the resistive heat bodies 4 with respect to the center of the object to be heated larger than that in the vicinity of the left end portion thereof, it is possible to uniformly impart heat to the object to be heated inside the nip.

In the above-described embodiments a recess into which the heater 7 is to be fitted is formed in the stay 2. It is to be noted, however, that as the heating apparatus becomes smaller, the stay 2 also becomes smaller, so that when thermal stress is dissipated in the stay 2, there is the danger of a crack being dissipated in the recess. The embodiments of the present invention help to prevent dissipation of such a crack.

Sixth Embodiment

Figures 9A, 9B:
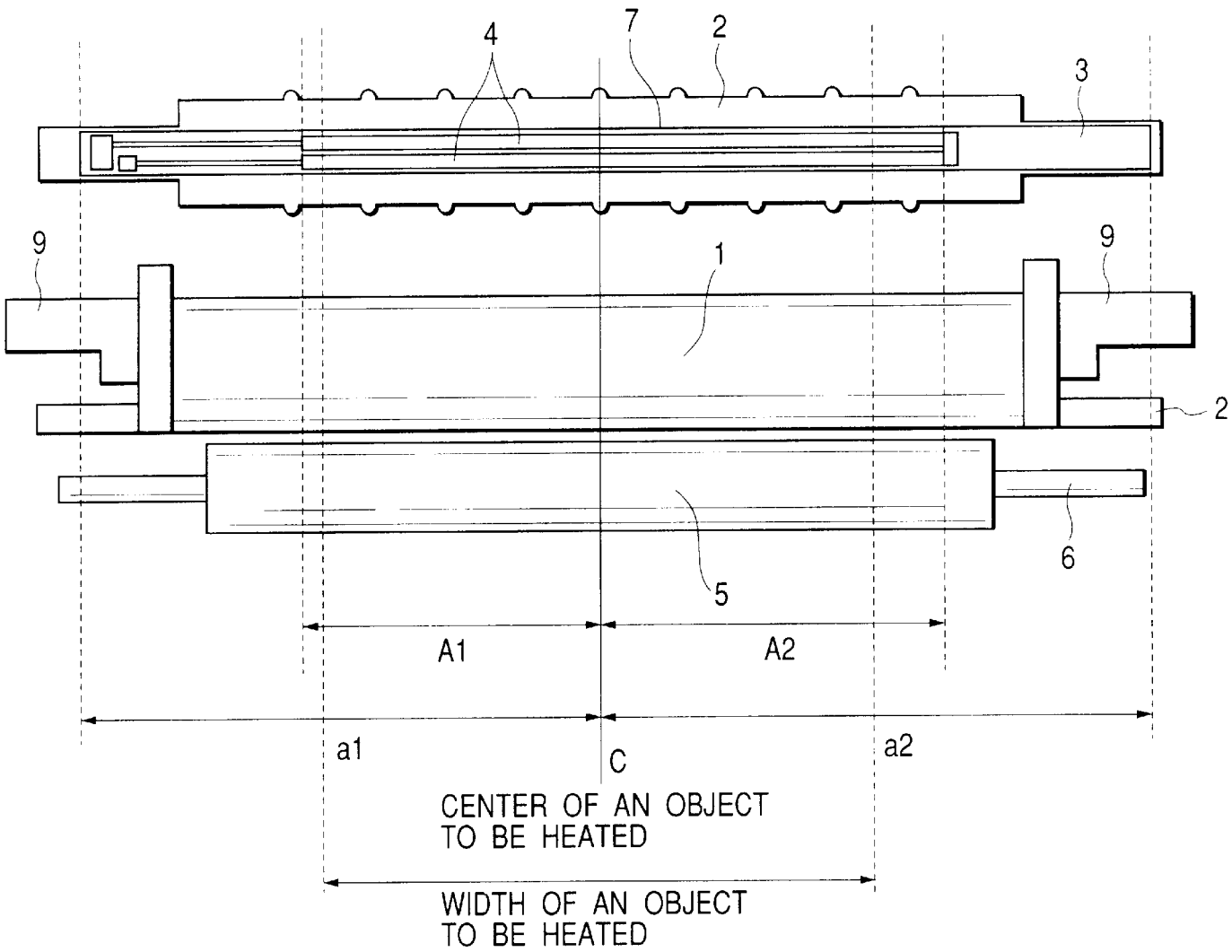
FIGS. 9A and 9B are schematic diagrams showing a fixing device according to a sixth embodiment.

FIG. 9A is a view, as seen from the nip side, of the stay 2 also serving as a heater holder, with the heater 7 being attached thereto. FIG. 9B is a schematic view, as seen from the advancing direction of the object to be heated, showing the positional relationship between the heater unit to which the stay 2 is attached and the pressure roller 5.

The heater 7 is formed by applying to the surface of the heater substrate 3 formed of alumina or the like an electrically resistive material, such as Ag/Pd (silver-palladium), by screen printing or the like to a thickness of approximately 10 μm and in a width of 13 mm, and providing thereon a coating of glass, fluororesin or the like serving as a protecting film. The thermal conductivity of the heater substrate 3 is 50 to 150 [W/m·k].

And, a temperature control device (not shown) performs control such that a fixed temperature is maintained in the paper conveyance area.

The stay 2 is formed by the molding of a heat resisting resin, such as PPS, liquid crystal polymer, or phenol resin. To achieve a reduction in heat capacity and an improvement in terms of quickness in starting, the film 1 is formed into a total thickness of not more than 100 μm, more preferably, not more than 40 μm and not less than 20 μm, using a single layer film of PTFE, PFA, FEP or the like, which excels in heat resistance, mold releasing property, strength, durability, etc., or a composite layer film formed by providing a coating of PTFE, PFA, FEP or the like on the outer peripheral surface of a layer of polyimide, polyamide imide, PEEK, PES, PPS or the like.

The way the recording paper sheet is heated together with toner thereon in the press contact nip portion of the heating apparatus (fixing device) is shown in FIG. 7. As shown in FIGS. 9A and 9B, in this embodiment, assuming that the respective distances from the center C (central conveyance reference) of the recording paper sheet serving as the object to be heated to the left end and the right end of the heater substrate 3 are a1 and a2, the following relationship is established: a1<a2.

In this embodiment, when the above-mentioned conductive ring is provided on the right-hand side of the roller shaft 6 of the pressure roller 5, it is to be assumed that the quantity of heat flowing out of the resistive heat bodies 4 is larger on the right-hand side. Thus, when the respective distances from the center C of the object to be heated to the right and left ends of the resistive heat bodies 4 are the same, heat is not uniformly imparted to the object to be heated inside the nip.

Figure 14:
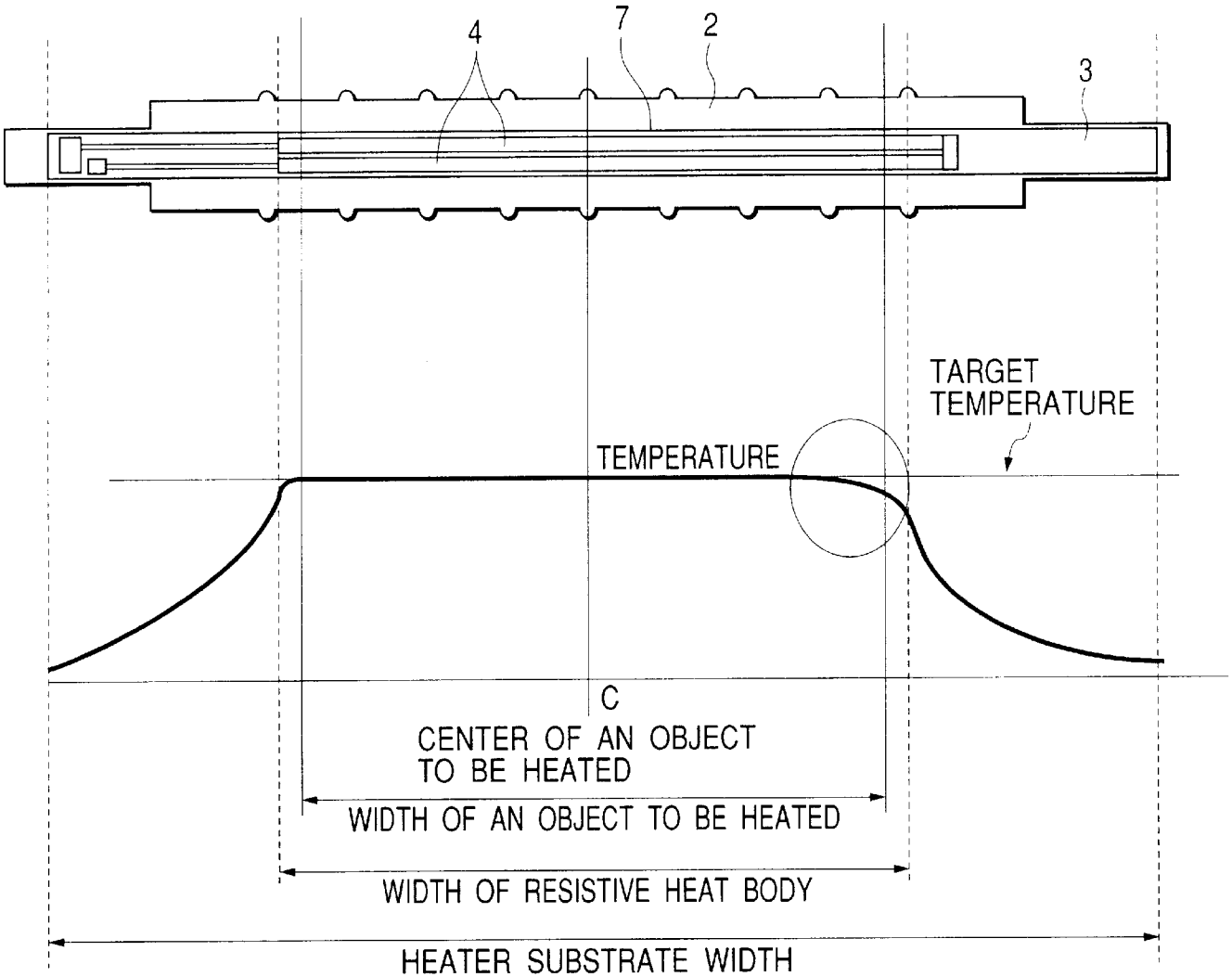
FIG. 14 is a diagram showing temperature distribution in a fixing device.

FIG. 14 shows an example of the temperature distribution inside the nip in this case. The temperature of the encircled portion is lower than the target temperature within the range of the width of the object to be heated. To solve this problem, as shown in FIGS. 9A and 9B, the following length relationship is established: A1<A2, where A1 and A2 are the respective distances from the center C of the object to be heated to the left end and the right end of the resistive heat bodies 4.

The length of each of the resistive heat bodies 4, (A1+A2), is larger than the maximum width of the recording material that can be conveyed, which is the object to be heated, and, at both ends, the end portions of the resistive heat bodies 4 extend beyond the end portions of the object to be heated.

At both ends of the resistive heat bodies 4, heat is likely to escape to the end portions of the heater substrate 3. On the other hand, by providing a portion where there is no heat radiation due to paper conveyance, this is compensated for to thereby achieve a uniform temperature distribution.

Seventh Embodiment

Figures 10A, 10B:
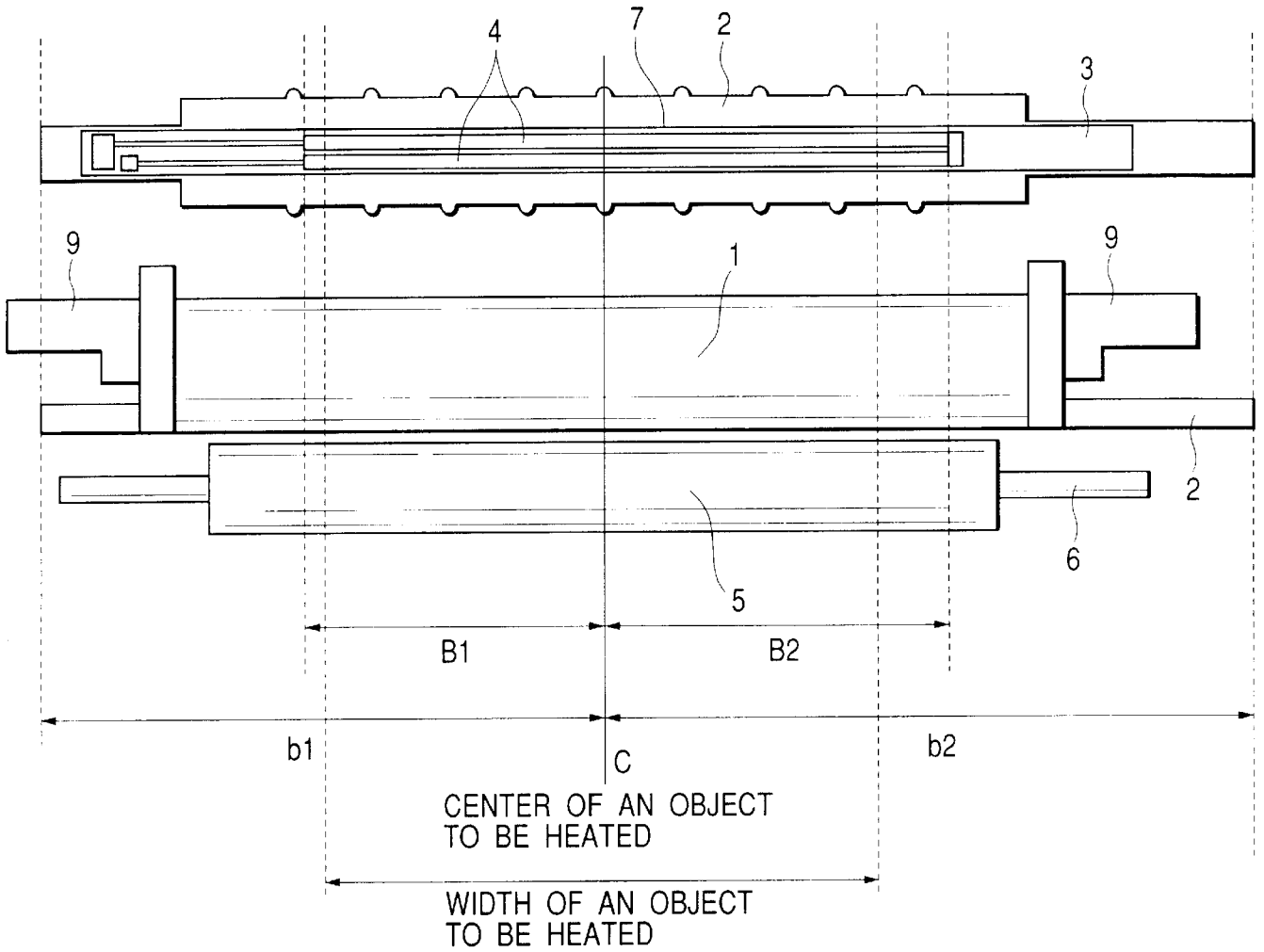
FIGS. 10A and 10B are schematic diagrams showing a fixing device according to a seventh embodiment.

FIGS. 10A and 10B show a seventh embodiment, in which the respective distances from the center C of the object to be heated to the right and left ends of the stay 2 are different.

FIGS. 10A and 10B are schematic diagrams similar to the one showing the sixth embodiment. In the sixth embodiment, the respective distances from the center C of the object to be heated to the right and left ends of the heater substrate 3 are different. By contrast, in this embodiment, shown in FIGS. 10A and 10B, while the respective distances from the center C of the object to be heated to the right and left ends of the heater substrate 3 are the same, the respective lengths from the center C of the object to be heated to the left and right ends of the stay 2, b1 and b2, respectively, are different. When b1<b2, it is to be assumed that the quantity of heat flowing out of the resistive heat bodies 4 is larger on the right-hand side since the stay 2 extends longer on the right-hand side.

In this embodiment, for the same reason as that in the sixth embodiment, the following relationship is established: B1<B2, where B1 and B2 are the respective distances from the center C of the object to be heated to the left and right ends of the resistive heat bodies 4.

The length of each of the resistive heat bodies 4, (B1+B2), is larger than the maximum width of the object to be heated that can be conveyed, and, at both ends, the end portions of the resistive heat bodies 4 extend beyond the end portions of the object to be heated. At both ends of the resistive heat bodies 4, heat is likely to escape to the end portions of the heater substrate 3. This is compensated for by providing a portion where there is no heat radiation due to paper conveyance, thereby achieving a uniform temperature distribution.

Eighth Embodiment

Figures 11A, 11B:
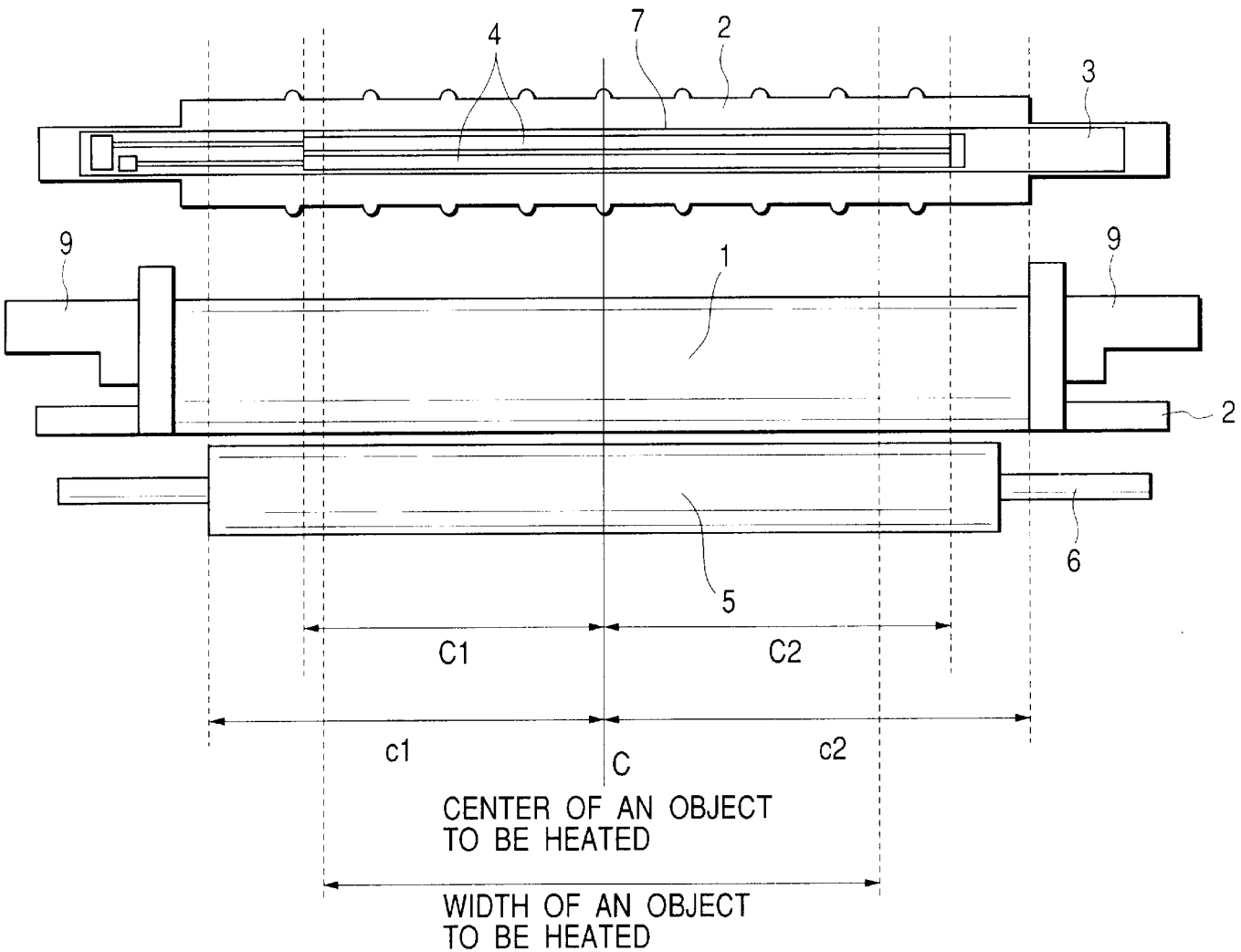
FIGS. 11A and 11B are schematic diagrams showing a fixing device according to an eighth embodiment.

FIGS. 11A and 11B show an eighth embodiment, in which the respective distances from the center C of the object to be heated to the right and left ends of the pressure roller 5 are different.

FIGS. 11A and 11B are schematic diagrams similar to the one showing the sixth embodiment. The end portions of pressure roller 5 are in contact with the portions of the heater substrate 3 where there are no resistive heat bodies 4. Further, the pressure roller 5 rotates, and its surface is in contact with air while constantly moving at a speed, so that it is easily cooled. Thus, a large quantity of heat is likely to escape from the end portions of the resistive heat bodies 4 to the end portions of the pressure roller 5 through the heater substrate 3.

In view of this, in this embodiment, shown in FIGS. 11A and 11B, the following length relationship is established: c1<c2, where c1 and c2 are the respective distances from the center C of the object to be heated to the left and right ends of the pressure roller 5.

In order that heat may be uniformly imparted to the object to be heated inside the nip, the following relationship is established in this embodiment: C1<C2, where C1 and C2 are the respective distances from the center C of the object to be heated to the left and right ends of the resistive heat bodies 4.

The length of each of the resistive heat bodies 4, (C1+C2), is larger than the maximum width of the object to be heated that can be conveyed, and, at both ends, the end portions of the resistive heat bodies 4 extend outwardly beyond the end portions of the object to be heated.

In this embodiment, at both ends of the resistive heat bodies 4, heat is likely to escape to the end portions of the pressure roller through the end portions of the heater substrate 3. This is compensated for by providing a portion where there is no heat radiation due to paper conveyance, thereby achieving a uniform temperature distribution.

Figures 13A, 13B:
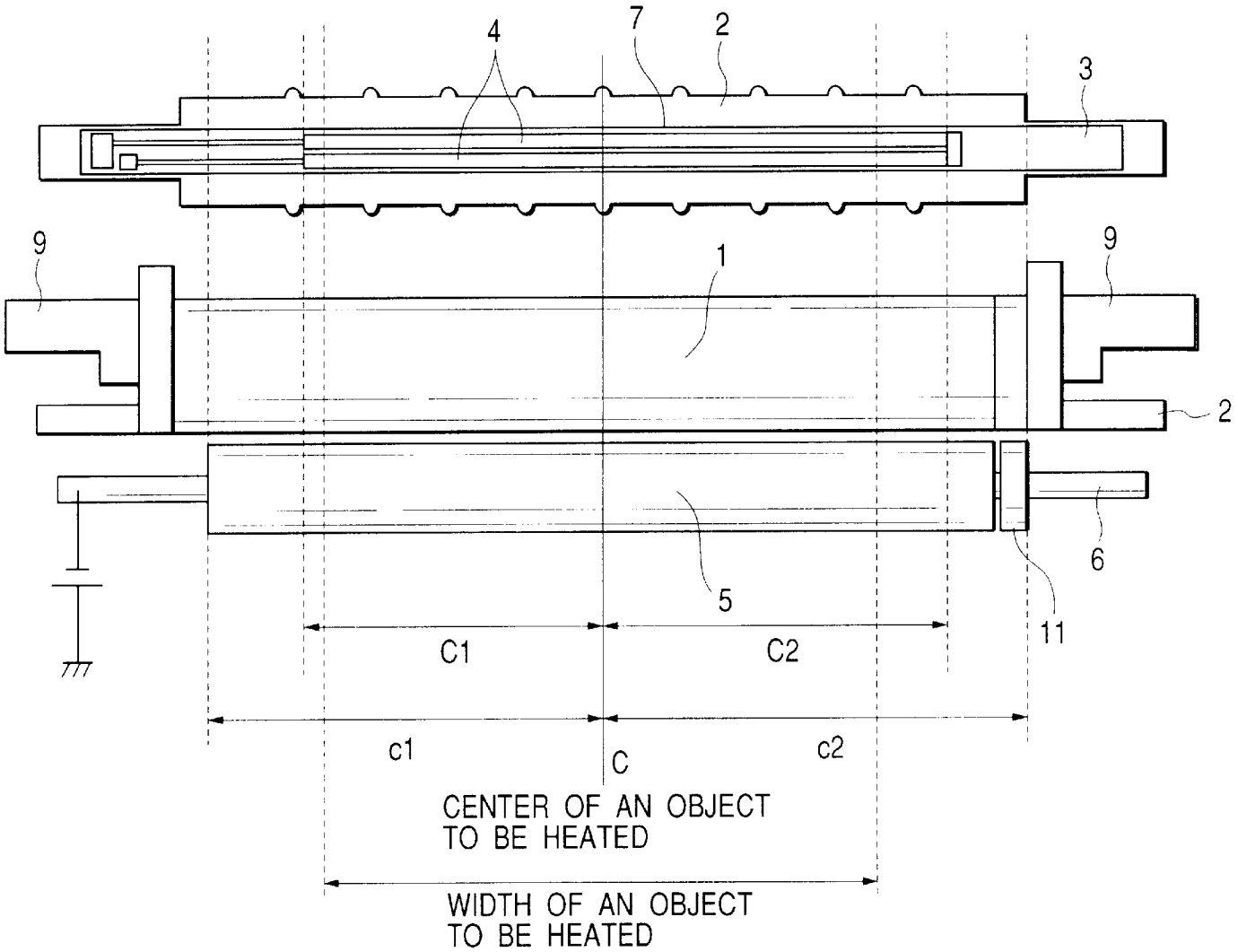
FIGS. 13A and 13B are schematic diagrams showing an example of the case in which a film biasing ring is used.

As shown in FIGS. 13A and 13B, when attaching a ring 11 formed of a conductive rubber or the like to an end portion of the pressure roller 5 to apply a bias to the film through the roller shaft 6 serving as the core bar of the pressure roller 5, the ring 11 has substantially the same diameter as the pressure roller 5 and it is to be assumed that heat comes from the film 1 even if it is not in contact with the pressure roller 5. Thus, it is to be regarded as a part of the pressure roller 5. Then, it is possible to uniformly heat the object to be heated by making the right and left lengths of the resistive heat bodies different as in this embodiment.

Ninth Embodiment

Figures 12A, 12B:
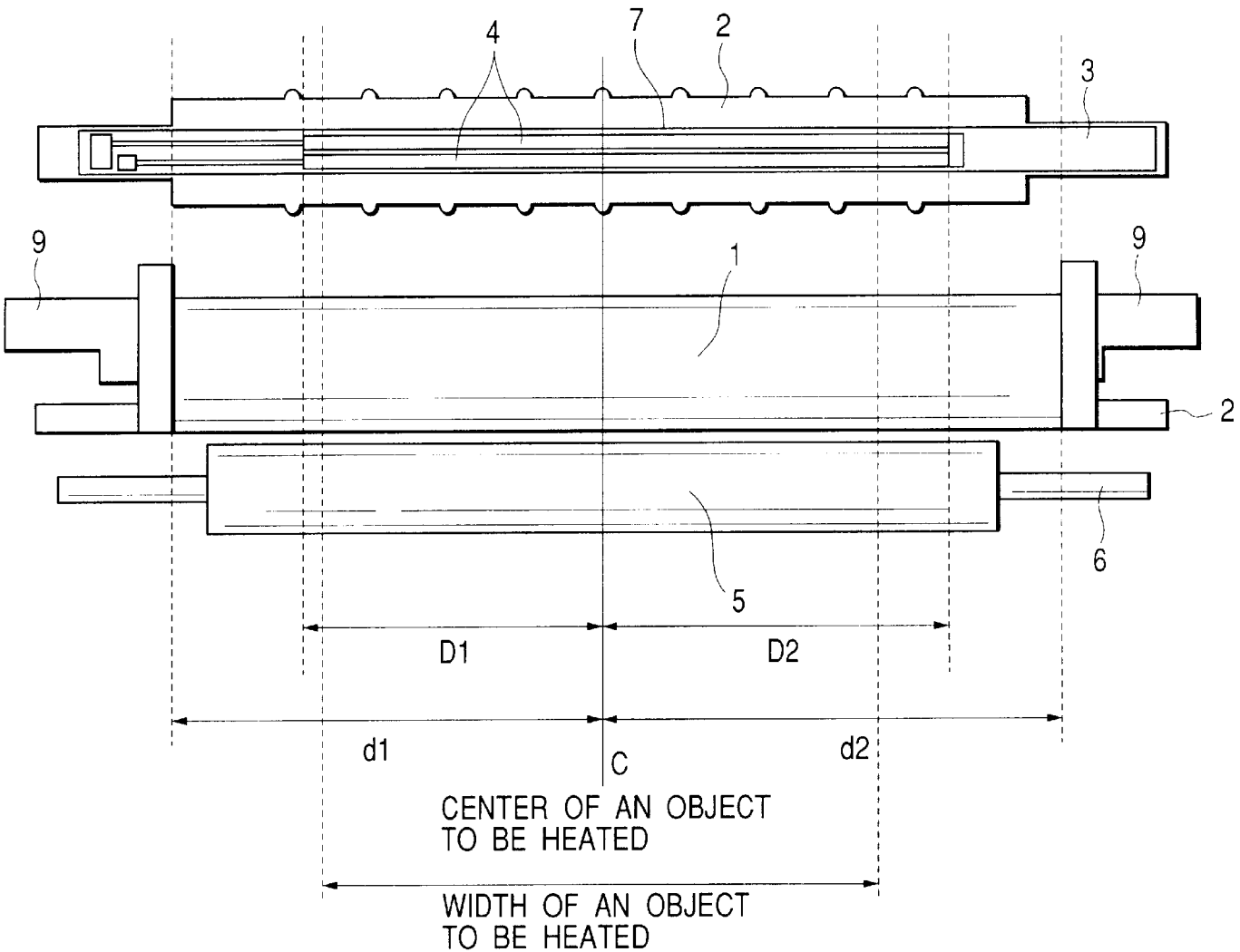
FIGS. 12A and 12B are schematic diagrams showing a fixing device according to a ninth embodiment.

FIGS. 12A and 12B show a ninth embodiment, in which the respective distances from the center C of the object to be heated to the right and left ends of the film 1 are different.

FIGS. 12A and 12B are a schematic diagram similar to the one showing the sixth embodiment. In this embodiment, the respective distances from the center C of the object to be heated to the right and left ends of the film 1 are different. This construction is adopted in the case where the right and left portions of the flange 9 are different.

The end portions of the film 1 are in contact with the portions of the heater substrate 3 where there are no resistive heat bodies 4. Further, the film 1 rotates, and its surface is in contact with air while constantly moving at a speed, so that it is easily cooled. Thus, a large quantity of heat is likely to escape from the end portions of the resistive heat bodies 4 to the end portions of the film 1 through the heater substrate 3.

As shown in FIGS. 12A and 12B, in this embodiment, the following relationship is established: d1<d2, where d1 and d2 are the respective distances from the center C of the object to be heated to the left and right ends of the film 1.

In this case also, in order to uniformly impart heat to the object to be heated inside the nip, the respective distances D1 and D2 from the center C of the object to be heated to the left and right ends of the resistive heat bodies 4 are in the following relationship: D1<D2.

The length of each of the resistive heat bodies, (D1+D2), is larger than the maximum width of the object to be heated that can be conveyed, and, at both ends, the end portions of the resistive heat bodies extend outwardly beyond the end portions of the object to be heated. At both ends of the resistive heat bodies, heat is likely to escape to the end portions of the heater substrate. This is compensated for by providing a portion where there is no heat radiation due to paper conveyance, thereby achieving a uniform temperature distribution.

Further, as in the fifth embodiment, regardless of whether the fan 10 is performing in-take operation or exhaust operation, the ambient temperature is likely to be low on the side of the fixing device nearer to the fan 10, so that it is to be assumed that heat escape is likely to occur. Thus, even if there is no difference in the way heat escapes between the right and left sides of the fixing device, there is the possibility of the influence of the fan 10 being exerted on one side of the center of the object to be heated. In this case also, the above problem can be solved by making the distance from the center C of the object to be heated to the end of each of the resistive heat bodies 4 longer on the side where heat is more likely to be taken away.

While in this embodiment the heat bodies extend longitudinally all the way in the same width, it is also possible to provide a part having a different width. In particular, when the heat body width in the vicinity of the ends is smaller than that in the central portion, the heat dissipation amount per unit length in the vicinity of the ends increases, whereby it is possible to achieve a uniform temperature distribution.

In the above-described embodiments, a recess into which the heater 7 is fitted is formed in the stay 2. However, it is to be noted that as the size of the heating apparatus is reduced, the size of the stay 2 is also reduced, so that when thermal stress is dissipated in the stay 2, there is the danger of a crack being dissipated in the recess. In the embodiments of the present invention, it is also possible to prevent dissipation of such a crack.

Tenth Embodiment

Figures 15A, 15B:
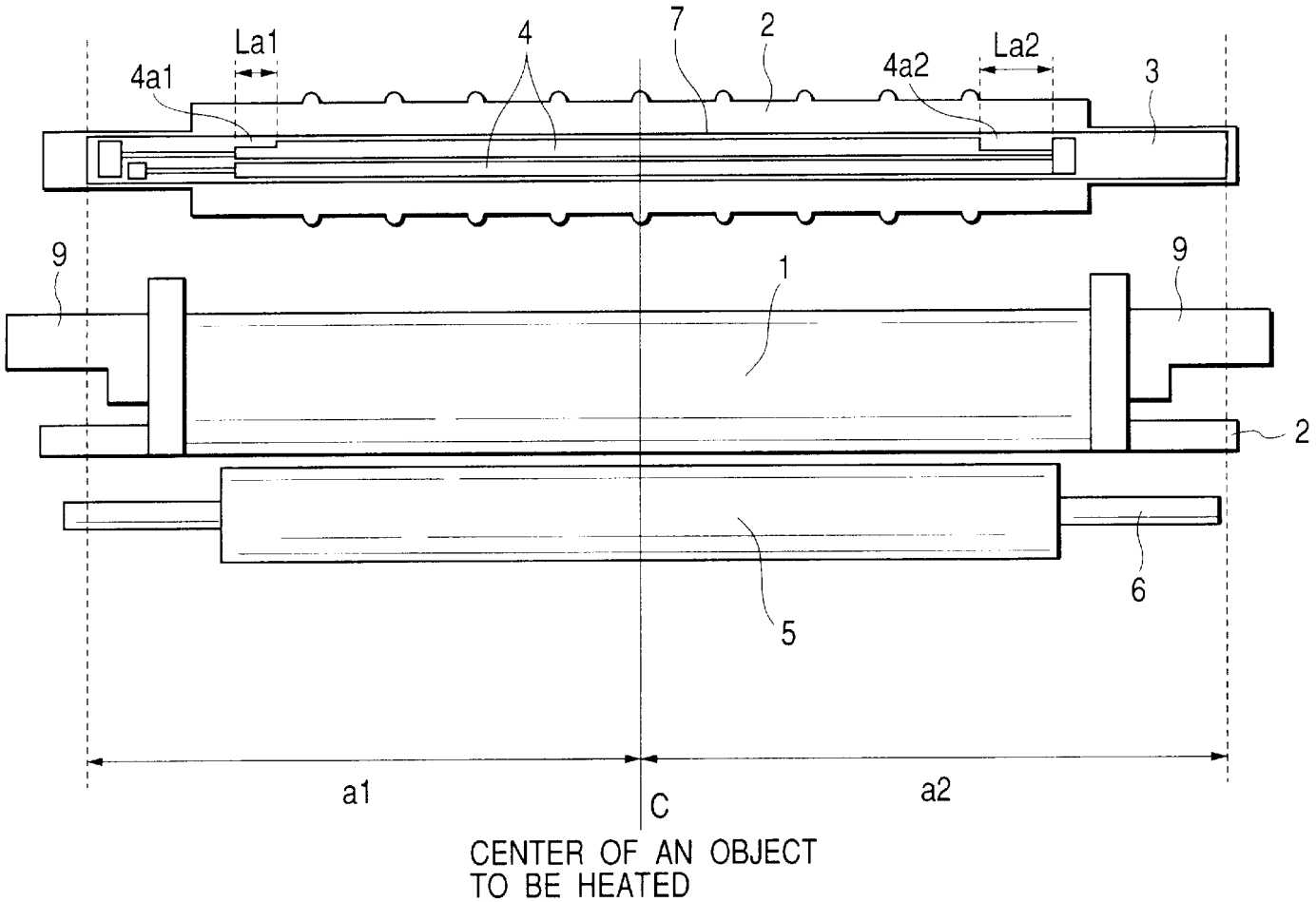
FIGS. 15A and 15B are schematic diagrams showing a fixing device according to a tenth embodiment.

As shown in FIGS. 15A and 15B, in this embodiment, the width of each of the resistive heat bodies 4 is relatively small in the vicinity of the left and right end portions 4*a*1 and 4*a*2 in the direction in which the object to be heated is conveyed, so that, as compared with the central portion, the longitudinal heat dissipation amount per unit length in these regions is larger. Assuming that the respective lengths from the center C of the object to be heated to the left and right ends of the heater substrate 3 are a1 and a2, a1<a2, so that the quantity of heat flowing out from the end portions of the resistive heat bodies 4 without contributing to fixing is larger on the right-hand side. Thus, when the respective lengths from the center of the object to be heated to the left and right ends of the resistive heat bodies 4 are the same, the fixing property is poorer in the vicinity of the right-hand end portion.

To cope with this, in this embodiment, the longitudinal heat dissipation amount per unit length in the left and right end portions 4*a*1 and 4*a*2 is made larger than the longitudinal heat dissipation amount per unit length in the central portion. Further, the line widths of the narrower portions of the resistive heat bodies 4 at the left and right end portions 4*a*1 and 4*a*2 are the same, and the longitudinal length La2 of the right-hand end portion 4*a*2 is larger than the longitudinal length La1 of the left-hand end portion 4*a*1, whereby the heat dissipation in the right-hand end portion 4*a*2 of the resistive heat bodies 4 is larger than that in the left-hand end portion 4*a*1.

Eleventh Embodiment

Figures 16A, 16B:
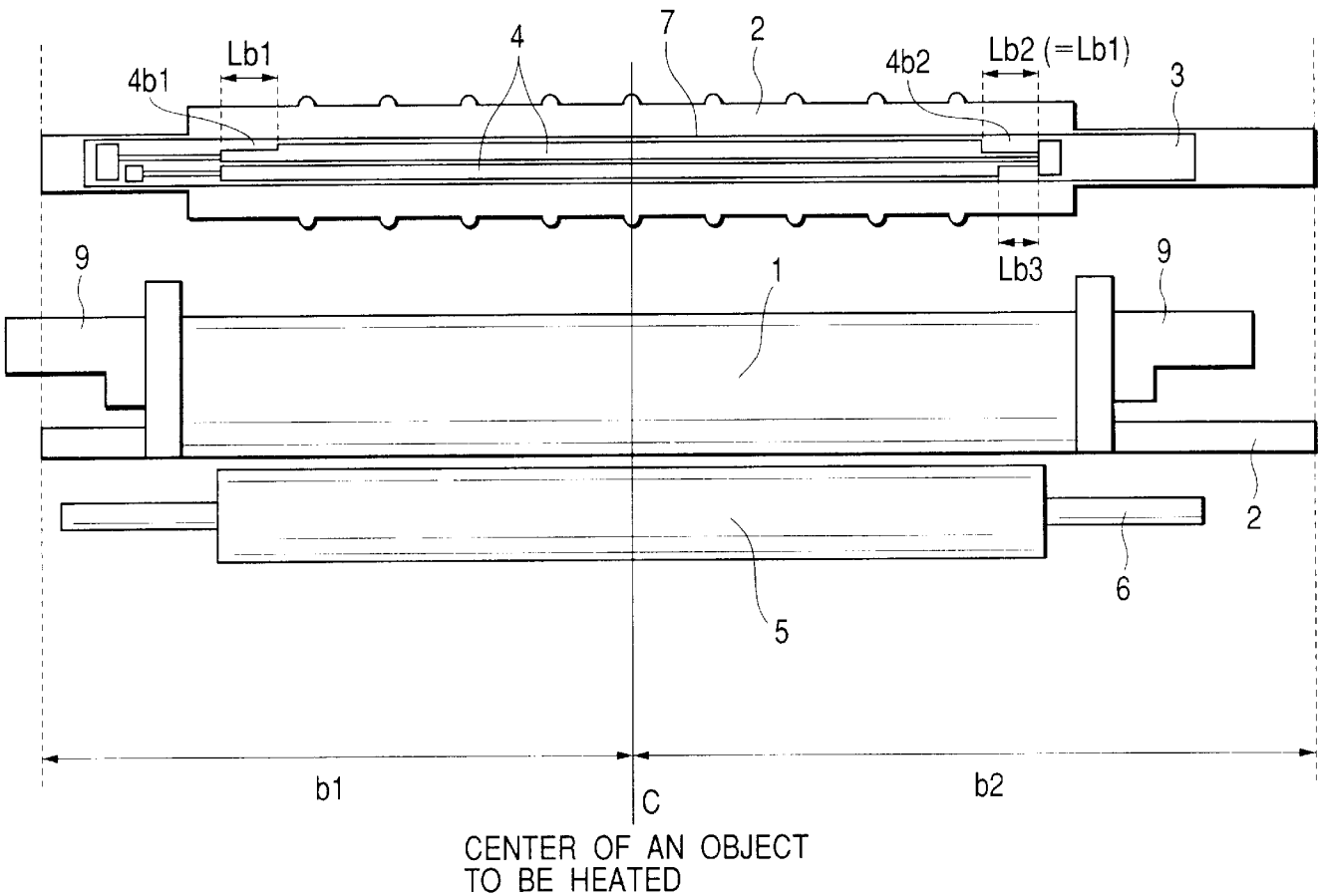
FIGS. 16A and 16B are schematic diagrams showing a fixing device according to an eleventh embodiment.

FIGS. 16A and 16B show an eleventh embodiment. In this embodiment, the respective distances from the center C of the object to be heated to the right and left ends of the stay 2 are different.

FIGS. 16A and 16B are schematic diagrams similar to the one showing the tenth embodiment. In the tenth embodiment, the respective lengths from the center C of the object to be heated to the right and left ends of the heater substrate 3 are different. By contrast, in FIGS. 16A and 16B, while the respective lengths from the center C of the object to be heated to the right and left ends of the heater substrate 3 are the same, the following length relationship is established: b1<b2, where b1 and b2 are the respective lengths from the center C to the left and right ends of the stay 2. Thus, the quantity of heat flowing out from the vicinity of the ends of the resistive heat bodies 4 is larger on the right-hand side since the stay 2 extends longer on the right-hand side.

As in the tenth embodiment, in this embodiment, the longitudinal heat dissipation amount per unit length in the end portions 4*b*1 and 4*b*2 is larger than that in the central portion, and the heat dissipation in the right-hand end portion 4*b*2 is larger than that in the left-hand end portion 4*b*1.

In this embodiment, of the two resistive heat bodies 4 arranged in parallel, one heat resistive heat body 4 (the upper one) has left and right end portions 4*b*1 and 4*b*2 whose lengths Lb1 and Lb2 are the same and which are made narrow in the same line width. Further, the other resistive heat body 4 has a right-hand end portion 4*b*2 which is formed in a small line width over its length Lb3.

Thus, the quantity of heat dissipated in the right-hand end portion 4*b*2 having the length Lb3 is larger than that dissipated in the left-hand end portion 4*b*1. In this case also, for the same reason as that in the tenth embodiment, the longitudinal length of the portion of the resistive heat bodies 4 where the longitudinal heat dissipation amount per unit length is larger than that in the central portion is substantially longer on the right-hand side, where the quantity of heat flowing out is larger than on the left-hand side.

Twelfth Embodiment

Figures 17A, 17B:
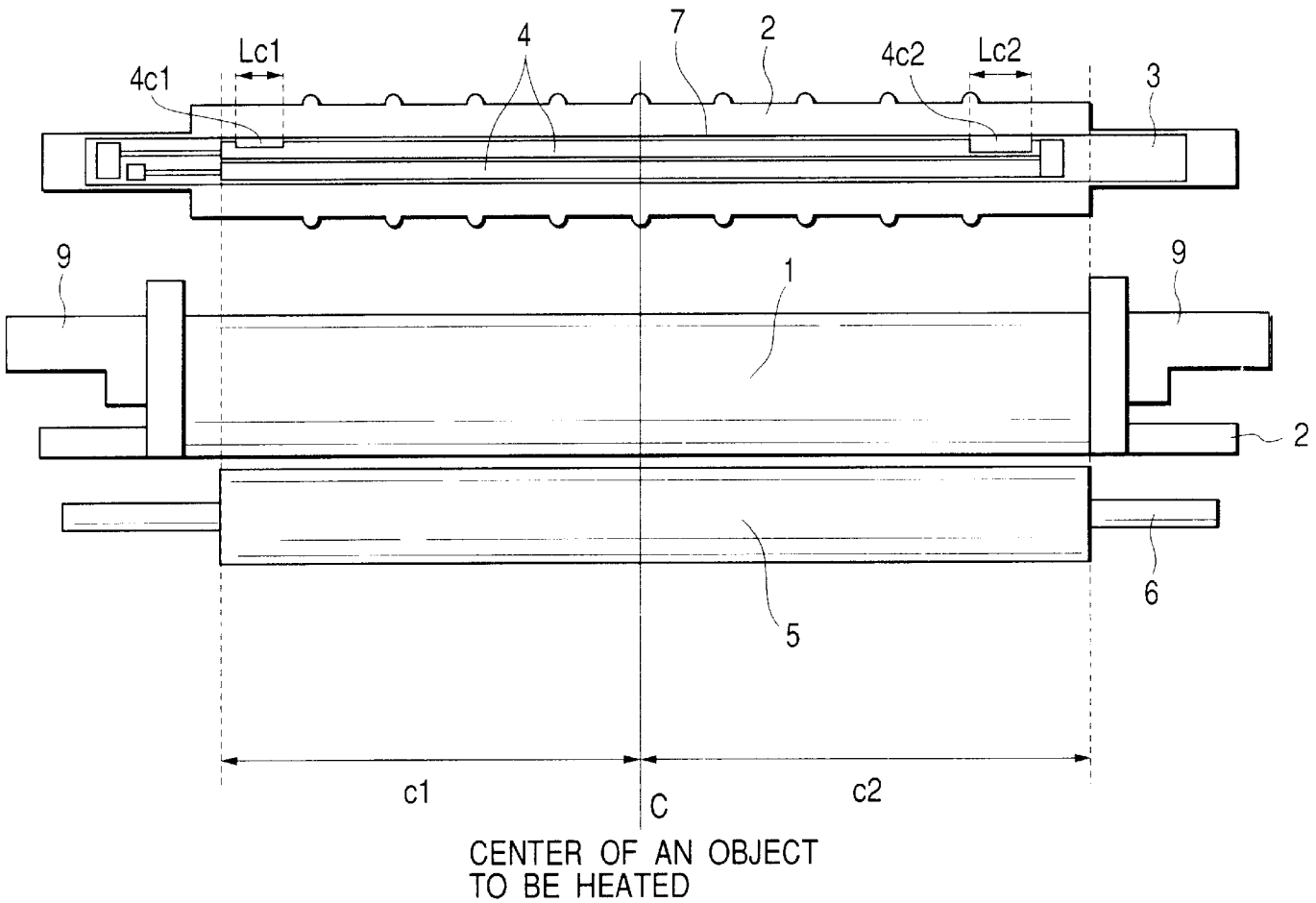
FIGS. 17A and 17B are schematic diagrams showing a fixing device according to a twelfth embodiment.

FIGS. 17A and 17B show a twelfth embodiment of the present invention. In this embodiment, the respective lengths from the center C of the object to be heated to the right and left ends of the pressure roller 5 are different.

FIGS. 17A and 17B are schematic diagrams similar to that showing the tenth embodiment. An end portion of the pressure roller 5 is in contact with the portion of the heater substrate 3 where there are no resistive heat bodies 4. Further, the pressure roller 5 rotates, and its surface is in contact with air while constantly moving at a speed, so that it is easily cooled. Thus, a large quantity of heat is likely to escape from the end portions of the resistive heat bodies 4 to the end portion of the pressure roller 5 through the heater substrate 3. As shown in FIGS. 17A and 17B, assuming that the respective lengths from the center C of the object to be heated to the left and right ends of the pressure roller 5 are c1 and c2, c1<c2.

Cutout portions are formed in the left and right end portions 4*c*1 and 4*c*2 of one resistive heat body 4. The narrow portions corresponding to the cutout portions of the left and right end portions 4*c*1 and 4*c*2 extend in the same line width, and the longitudinal heat dissipation amount per unit length in the left and right end portions 4*c*1 and 4*c*2 is larger than that in the central portion. Further, the length Lc2 of the right-hand end portion 4*c*2 is larger than the length Lc1 of the left-hand end portion 4*c*1, whereby the heat dissipation in the right-hand end portion 4*c*2 is larger than the heat dissipation in the left-hand end portion 4*c*1.

As in the above-described embodiment, in this case also, heat is more likely to flow out from the heat bodies on the right-hand side, where the pressure roller 5 extends longer. Thus, the heat dissipation in the right-hand end portion 4*c*2 is made larger than that in the left-hand end portion 4*c*1 so that heat may be uniformly imparted to the object to be heated inside the nip.

In the vicinity of the extreme ends of both resistive heat bodies 4, the longitudinal heat dissipation amount per unit length is the same as that in the central portion.

Figures 19A, 19B:
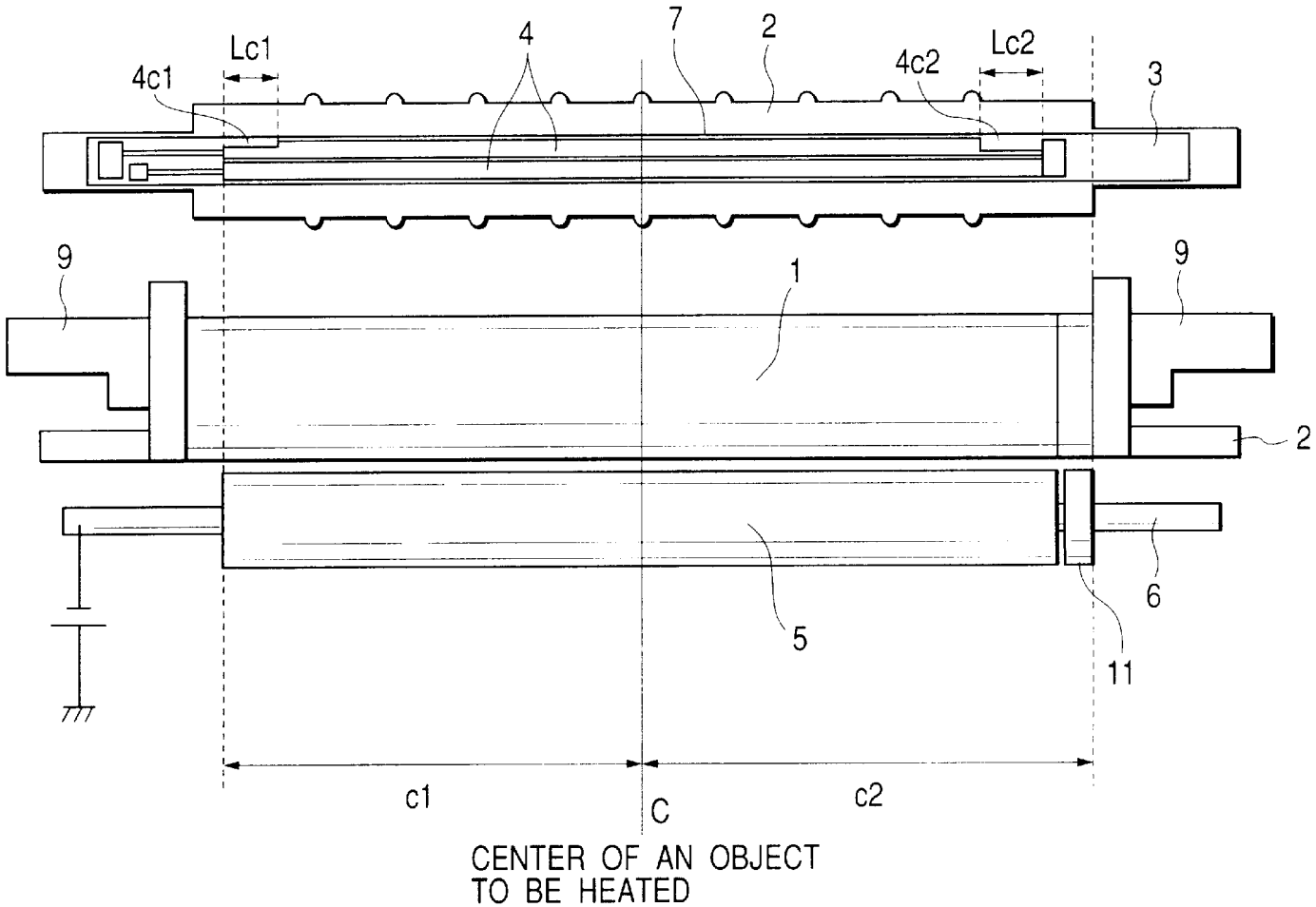
FIGS. 19A and 19B are schematic diagrams showing an example of the case in which a film biasing ring is used.

As shown in FIGS. 19A and 19B, when attaching a ring 11 formed of a conductive rubber or the like to an end portion of the pressure roller 5 to apply a bias to the film 1 through a core bar 6 of the pressure roller 5, the ring 11 has substantially the same diameter as the pressure roller 5 and it is to be assumed that heat comes from the film 1 even if it is not in contact with the pressure roller 5. Thus, it is to be regarded as a part of the pressure roller 5. Then, as in this embodiment, it is possible to uniformly heat the object to be heated by making the respective lengths of the portions in the vicinity of the right and left ends of the resistive heat bodies 4 where the longitudinal heat dissipation amount per unit length is larger than that in the central portion different.

Thirteenth Embodiment

Figures 18A, 18B:
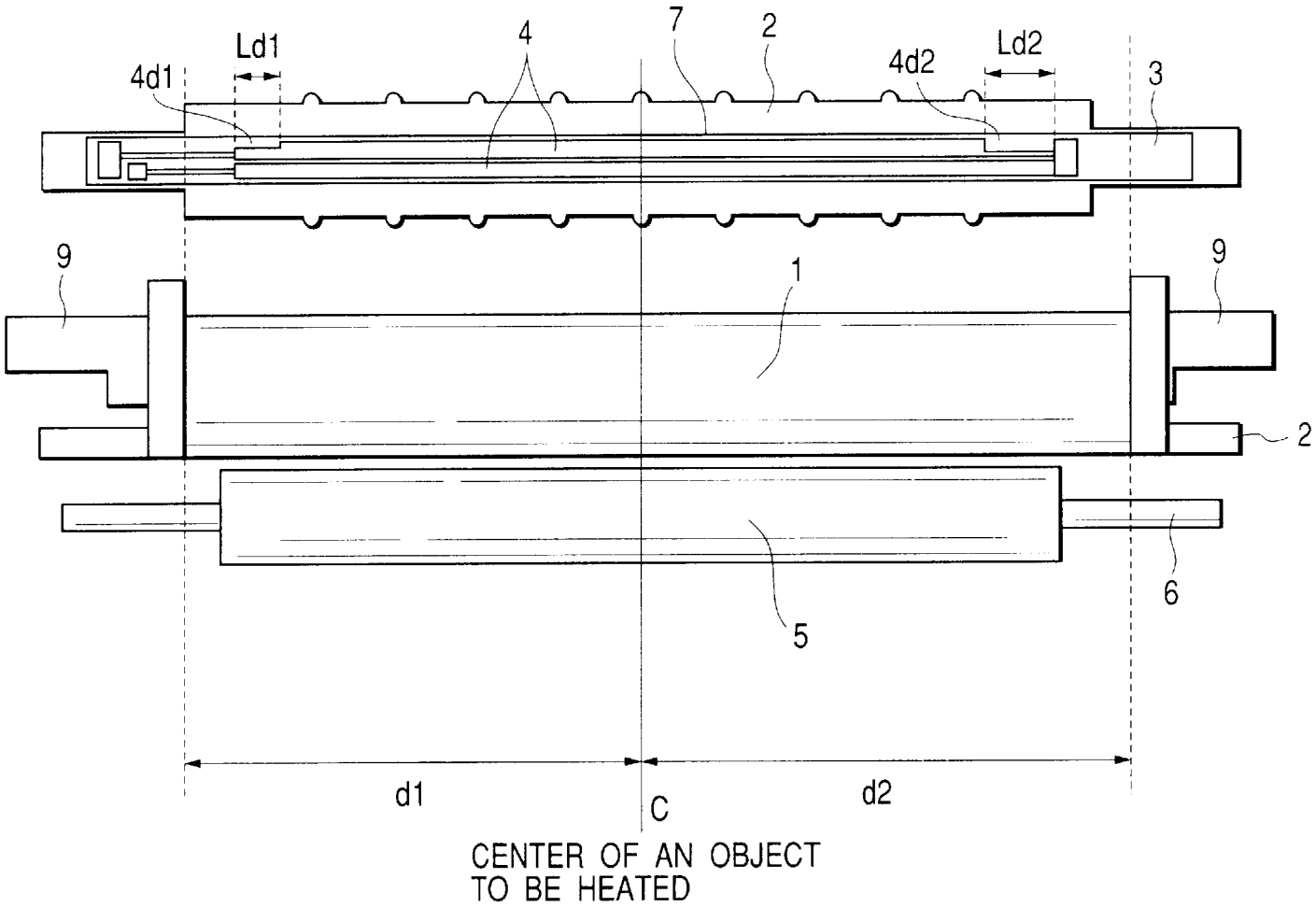
FIGS. 18A and 18B are schematic diagrams showing a fixing device according to a thirteenth embodiment.

FIGS. 18A and 18B show a thirteenth embodiment, in which the respective lengths from the center of the object to be heated to the right and left ends of the film 1 are different.

FIGS. 18A and 18B are schematic diagrams similar to the one showing the tenth embodiment. Such a construction is adopted when a flange 9 whose right and left portions are different is used. The end portions of the film 1 are in contact with the portions of the heater substrate 3 where there are no resistive heat bodies 4. Further, the film 1 rotates, and its surface is in contact with air while constantly moving at a speed, so that it is easily cooled. Thus, a large quantity of heat is likely to escape from the end portions of the resistive heat bodies 4 to the end portions of the film 1 through the heater substrate 3.

In this embodiment, shown in FIGS. 18A and 18B, assuming that the respective lengths from the center C of the object to be heated to the left and right ends of the film 1 are d1 and d2, d1<d2. In this case, heat is likely to be taken by the film 1, and, of the inner nip end portions, the temperature is higher on the right-hand side than on the left-hand side. To uniformly impart heat to the object to be heated inside the nip, the line widths of the left and right end portions 4*d*1 and 4*d*2 of the resistive heat bodies 4 with respect to the center C of the object to be heated are made smaller than that in the central portion, the longitudinal heat dissipation amount per unit length in the left and right end portions is made larger than that in the central portion, the length Ld2 of the right end portion 4*d*2 is made larger than the length Ld1 of the left end portion 4*d*1, and the heat dissipation in the right end portion 4*d*2 is made larger than that in the left end portion 4*d*1.

Further, as in the fifth embodiment, regardless of whether the fan 10 is performing in-take operation or exhaust operation, the ambient temperature is likely to be relatively low in the portion of the fixing device 1 nearer to the fan 10, so that it is to be assumed that heat can easily escape. Thus, even when there is no difference in the way heat escapes between the right and left portions of the fixing device, there is the possibility of the influence of the fan 10 being exerted on one side of the center of the object to be heated. In this case also, it is possible to uniformly impart heat to the object to be heated inside the nip by making the longitudinal length of the portions in the vicinity of the right-hand end of the resistive heat bodies 4 with respect to the center of the object to be heated, where the longitudinal heat dissipation amount per unit length is larger than that in the central portion, larger than the length of the left-hand end portions thereof.

While in this embodiment the width of the portions of the resistive heat bodies 4 in the vicinity of the ends and the width of the central portion thereof are fixed with respect to the right and left and the upstream and downstream sides, it is also possible to vary the width with respect to the right and left or the upstream and downstream sides.

In the above-described embodiments a recess into which the heater 7 is to be fitted is formed in the stay 2. It is to be noted, however, that as the heating apparatus becomes smaller, the stay 2 also becomes smaller, and when thermal stress is dissipated in the stay 2, there is the danger of a crack being dissipated in the recess. The embodiments of the present invention help to prevent dissipation of such a crack.

Fourteenth Embodiment

Figures 20A, 20B, 20C:
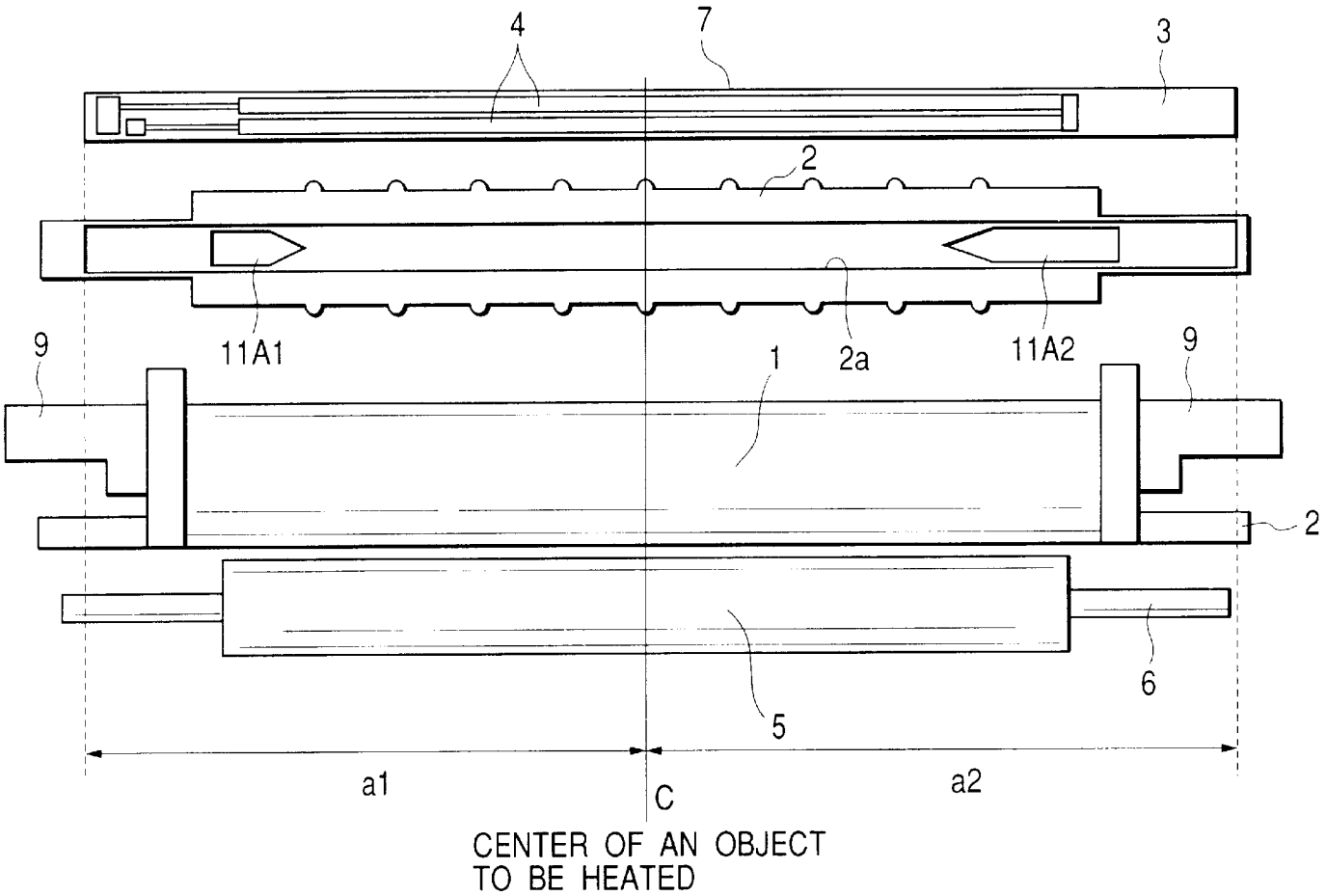
FIGS. 20A, 20B and 20C are schematic diagrams showing a fixing device according to a fourteenth embodiment.

As shown in FIGS. 20A to 20C, in this embodiment, the respective lengths from the center C of the object to be heated to the right and left ends of the heater substrate 3 are different.

Figures 25A, 25B:
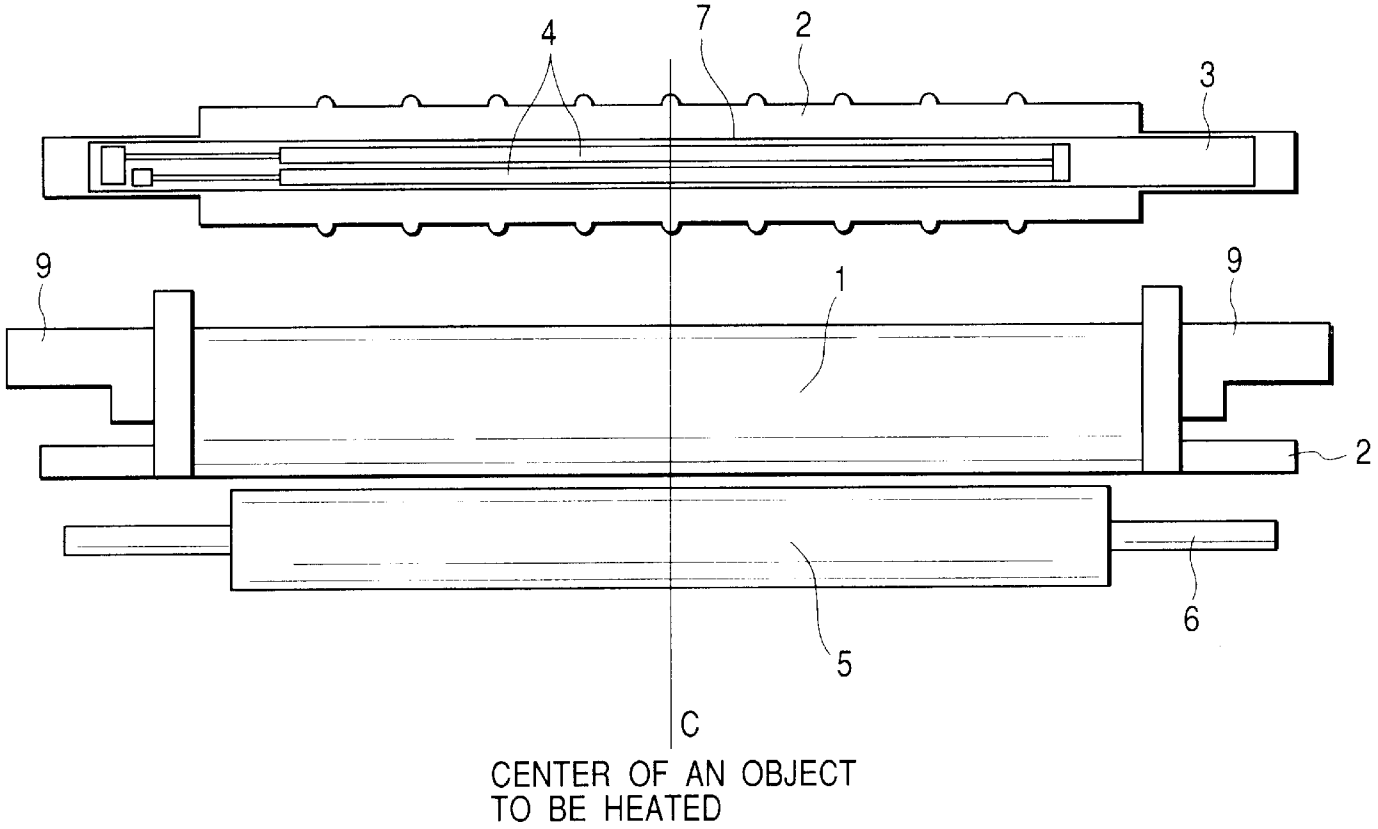
FIG. 25A is a schematic diagram showing a heater.
FIG. 25B is a front view of a fixing device.

FIG. 25A is a view, as seen from the nip side, of the stay 2 also serving as the heater holder, with the heater 7 attached thereto, and FIG. 25B is a schematic view, as seen from the direction in which the object to be heated advances, showing the positional relationship between the heater unit with the stay 2 attached thereto and the pressure roller 5.

The heater 7 is formed by applying to the surface of the heater substrate 3 formed of alumina or the like an electrically resistive material, such as Ag/Pd (silver-palladium), by screen printing or the like to a thickness of approximately 10 μm and in a width of 13 mm, and providing thereon a coating of glass, fluororesin or the like serving as a protecting film. The thermal conductivity of the heater substrate 3 is 50 to 150 [W/m·k].

And, a temperature control device (not shown) performs control such that a fixed temperature is maintained in the paper conveyance area.

The stay 2 is formed by the molding of a heat resisting resin, such as PPS, liquid crystal polymer, or phenol resin. To achieve a reduction in heat capacity and an improvement in terms of quickness in starting, the film 1 is formed in a total thickness of not more than 100 μm, more preferably, not more than 40 μm and not less than 20 μm, using a single layer film of PTFE, PFA, FEP or the like, which excels in heat resistance, mold releasing property, strength, durability, etc., or a composite layer film formed by providing a coating of PTFE, PFA, FEP or the like on the outer peripheral surface of a layer of polyimide, polyamide imide, PEEK, PES, PPS or the like. FIG. 7 shows how a recording material and toner thereon are heated in a press contact nip portion of a heating apparatus (fixing device).

FIG. 20A shows the heater substrate 3 serving as the insulating substrate equipped with the resistive heat bodies 4, and FIG. 20B shows the stay 2 holding the heater substrate 3. Formed in the stay 2 is a recess 2*a* into which the heater substrate 3 is fitted. By fitting the heater substrate 3 into the stay 2, the heater as the heating body is formed.

This heater is attached to the recess 2*a* in the frame indicated by the two-dot chain line when the stay 2 of the FIG. 20B is seen from the nip side. FIG. 25A shows the attached state, though there is a difference in length relationship. FIG. 20C is substantially the same as FIG. 25B.

Figure 24:
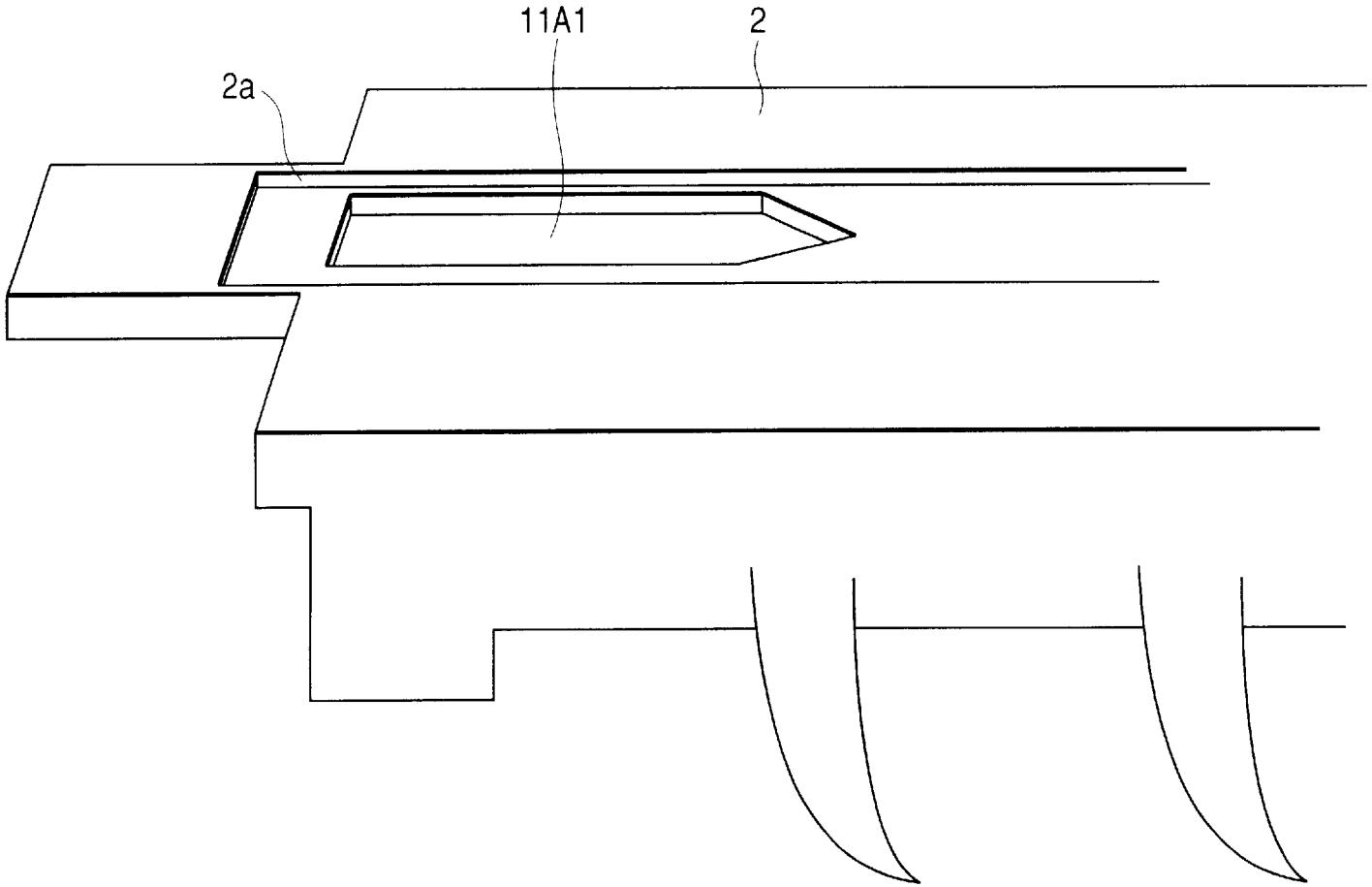
FIG. 24 is a perspective view of a stay.

As shown in FIG. 20B, formed in the bottom surface of the recess 2*a* of the stay 2 are left side and right side depressions 11A1 and 11A2, and these left side and right side depressions 11A1 and 11A2 are provided in correspondence with the left and right end portions of the resistive heat bodies 4. The opposing portions of the left side and right side depressions 11A1 and 11A2 have a pointed configuration, and the right side depression 11A2 is longer than the left side depression 11A1. FIG. 24 is an enlarged schematic perspective view of the depression 11A1.

As shown in FIG. 20C, assuming that the respective lengths from the center c of the object to be heated to the left and right ends of the heater substrate 3 are a1 and a2, a1<a2. In this case, it is to be assumed that the quantity of heat flowing out of the resistive heat bodies 4 is larger on the right-hand side than on the left-hand side. Thus, in this embodiment, of the depressions 11 provided in the vicinity of the end portions of the stay 2, the right side depression 11A2 has a higher heat insulating effect than the left side depression 11A1.

Figure 27:
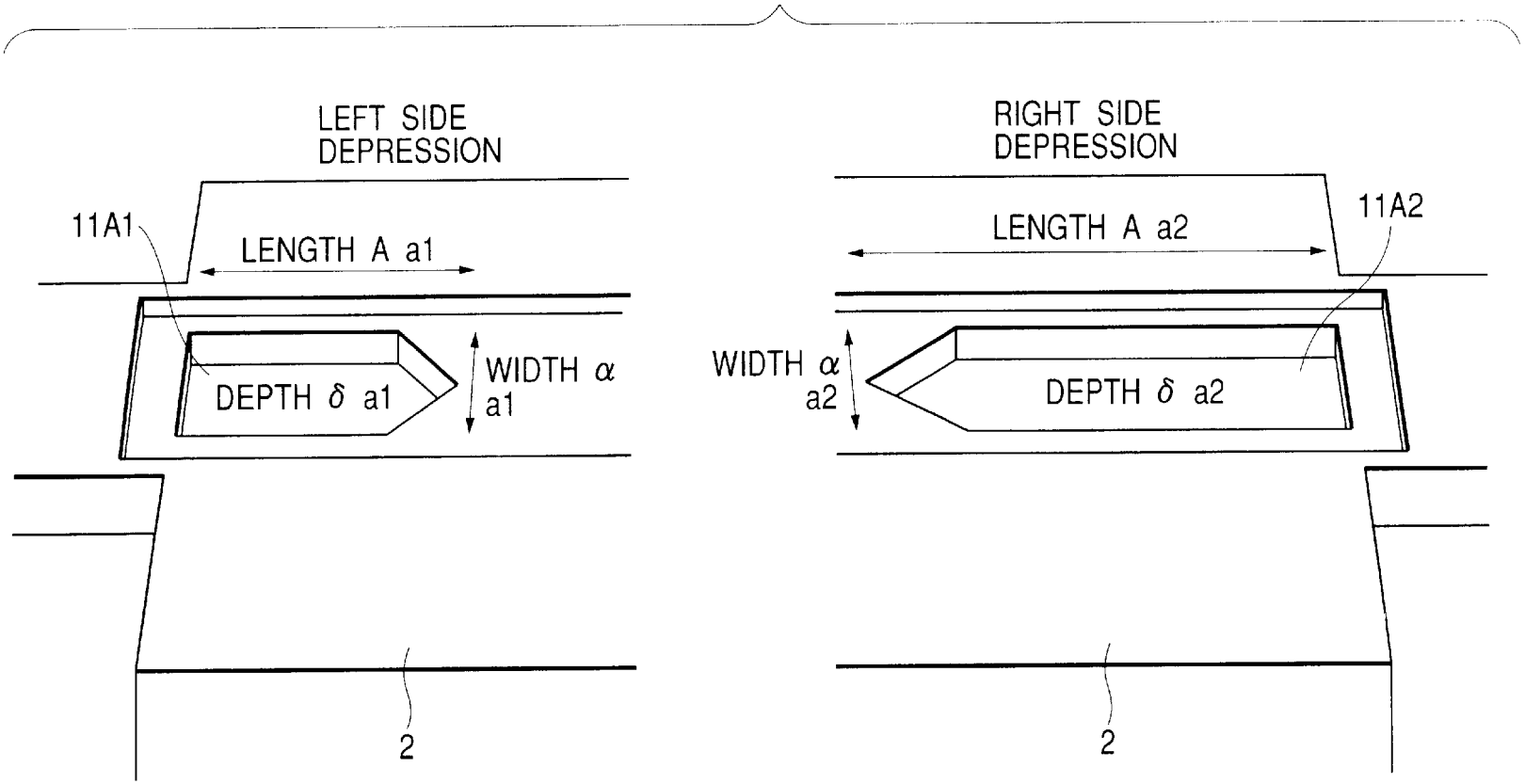
FIG. 27 is an enlarged perspective view of end portions of the stay of FIGS. 20A to 20C.
Figure 28:
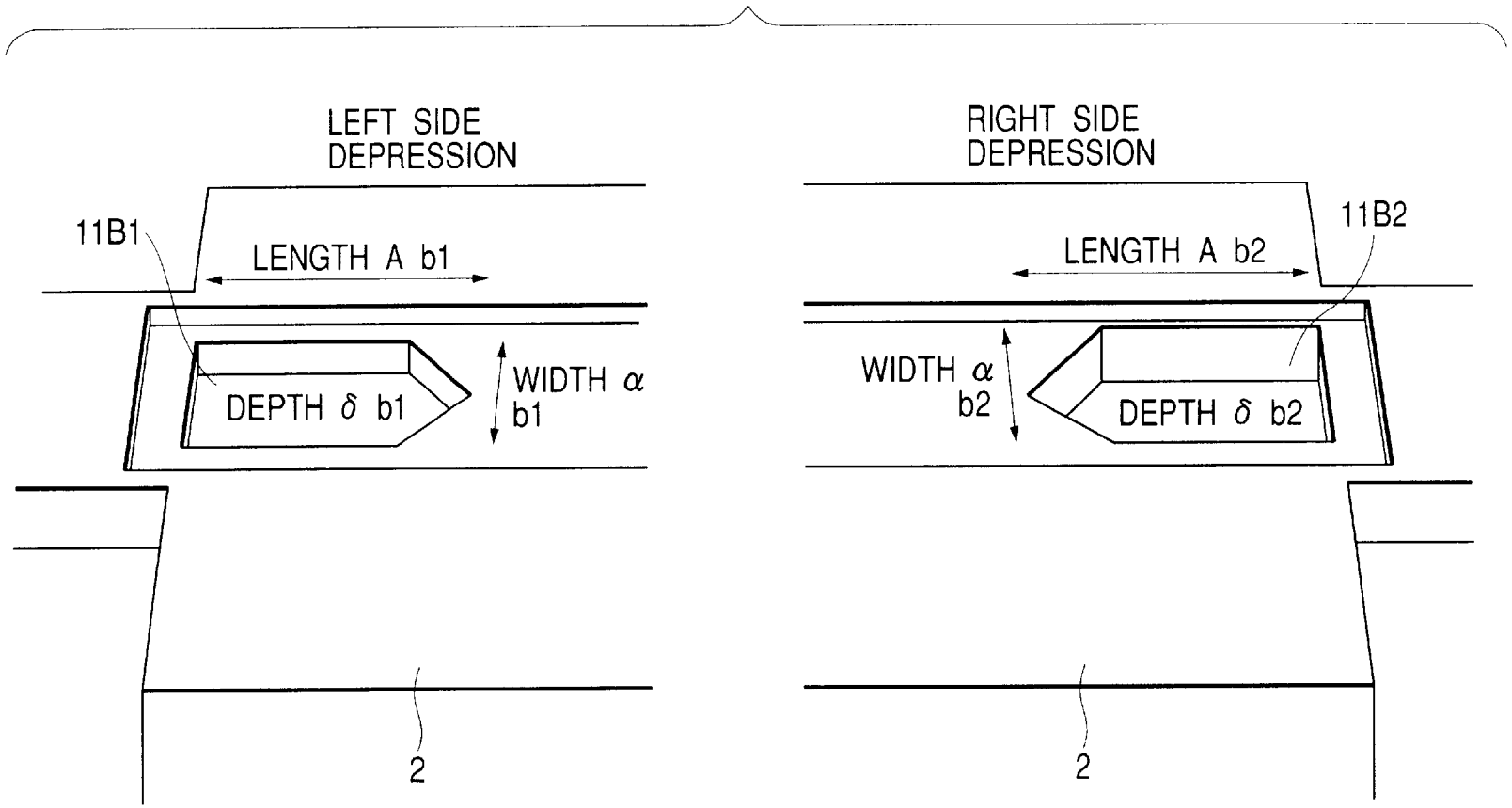
FIG. 28 is an enlarged perspective view of end portions of the stay of FIGS. 21A to 21C.

In this embodiment, the following arrangement is adopted to make the insulating effect of the right side depression 11A2 higher. As shown in FIG. 27, while the two depressions have the same width and the same depth ($\alpha a1=\alpha a1$, $\delta a1=\delta a2$), they have different longitudinal lengths ($Aa1<Aa2$).

The area of the right side depression 11A2 is naturally larger. Both the left side and right side depressions 11a1 and 11A2 in the vicinity of the stay end portions extend outwardly beyond the resistive heat bodies 4. By thus providing the left side and right side depressions 11A1 and 11A2 having different lengths (areas) in the vicinity of the stay end portions, it is possible to prevent heat from flowing out of the end portions of the resistive heat bodies 4 and to uniformly heat the object to be heated inside the nip.

Fifteenth Embodiment

Figures 21A, 21B, 21C:
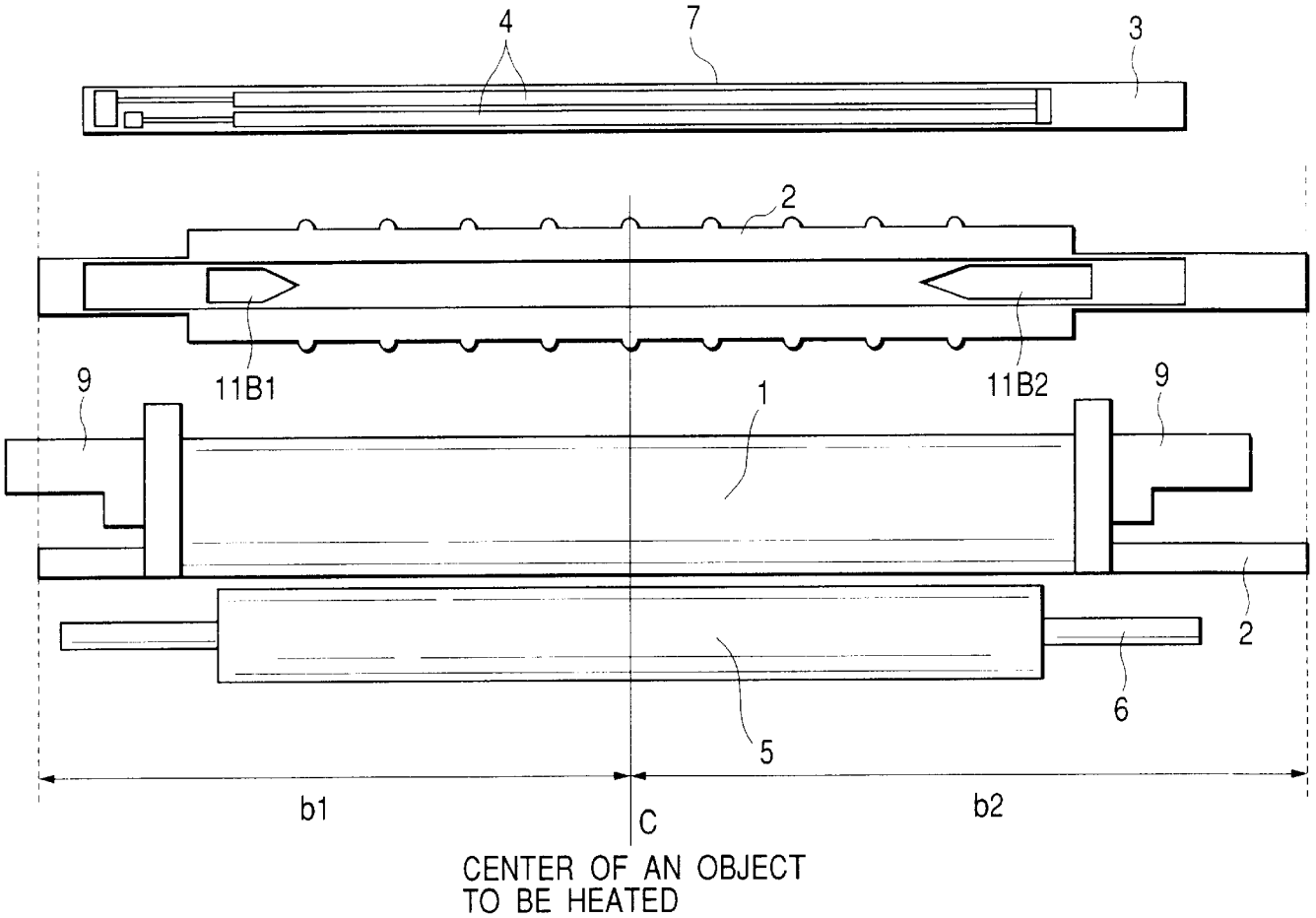

FIGS. 21A to 21C show a fifteenth embodiment of the present invention. In this embodiment, the respective lengths from the center of the object to be heated to the right and left ends of the stay 2 are different.

FIGS. 21A to 21C are schematic diagrams similar to FIGS. 20A to 20C. In the fourteenth embodiment, the respective lengths from the center C of the object to be heated to the right and left ends of the heater substrate 3 are different. By contrast, in this embodiment, shown in FIGS. 21A to 21C, while the respective lengths from the center C of the object to be heated to the right and left ends of the heater substrate 3 are the same, the following relationship is established: b1<b2, where b1 and b2 are the respective lengths from the center C to the left and right ends of the stay 2. Thus, it is to be assumed that the quantity of heat flowing out of the resistive heat bodies 4 is larger on the right-hand side, where the stay 2 extends longer.

As in the case of the fourteenth embodiment, in this embodiment, depressions 11B1 and 11B2 having different heat insulating effects are provided in the vicinity of the left and right end portions of the stay 2.

And, flowing-out of heat from the end portions of the resistive heat bodies 4 due to the length of the stay 2 is prevented, and heat is uniformly imparted in the longitudinal direction of the object to be heated inside the nip.

As shown in FIGS. 21A to 21C and FIG. 28, in this embodiment, while the left side and right side depressions 11B1 and 11B2 have the same lengths and widths (areas) ($Ab1=Ab2$, $\alpha b1=\alpha b2$), the depth of the right side depression 11B2 is larger than that of the left side depression 11B1 ($\delta b1<\delta b2$). By thus making their volumes different, their heat insulating effects are made different.

In this way, a depression which is deeper (whose volume is larger) is provided in the vicinity of the end portion of the stay 2 where the quantity of heat escaping is larger, whereby it is possible to achieve a high heat insulating effect and uniformly heat the object to be heated inside the nip.

Sixteenth Embodiment

Figures 22A, 22B, 22C:
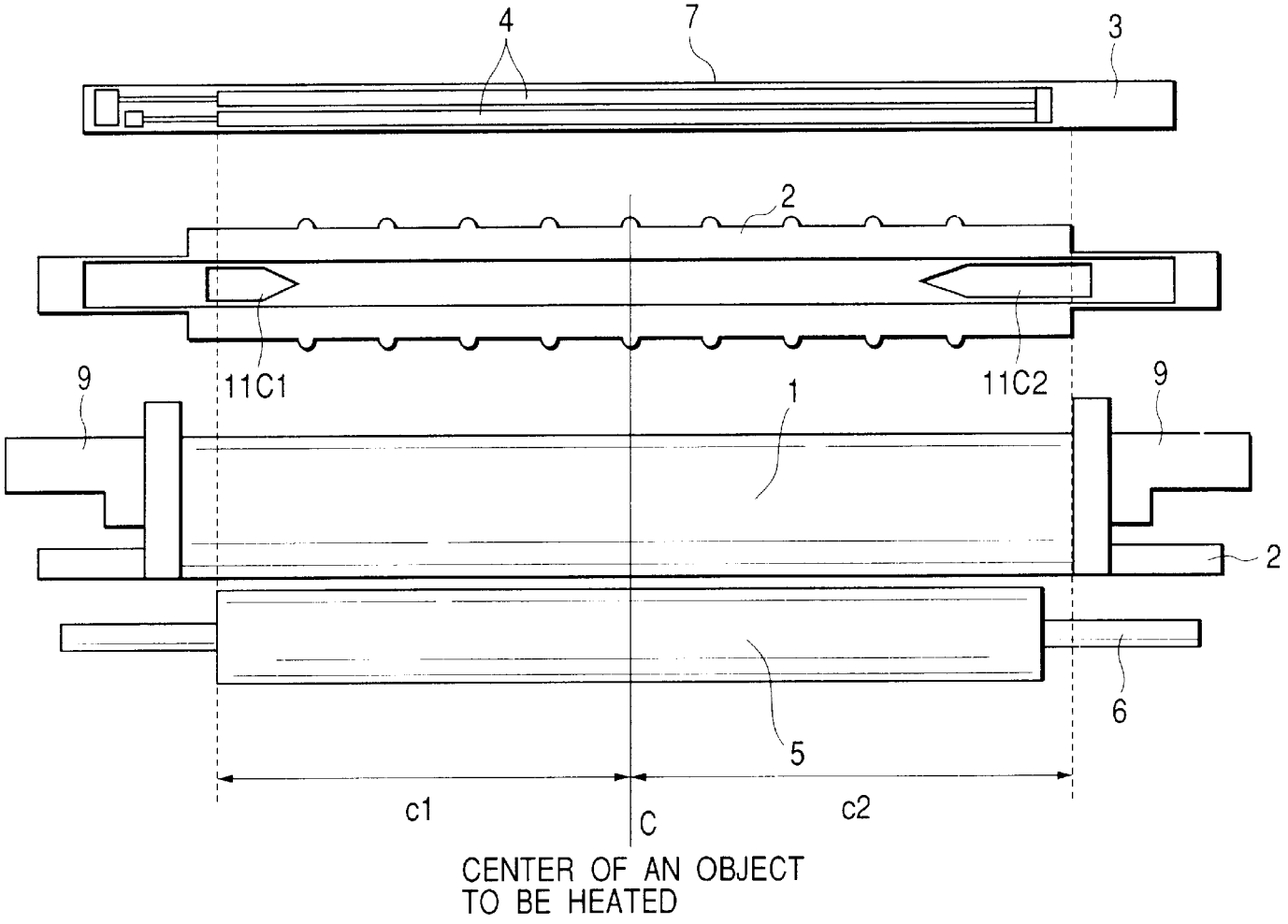
FIGS. 22A, 22B and 22C are schematic diagrams showing a fixing device according to a sixteenth embodiment.

FIGS. 22A to 22C show a sixteenth embodiment, in which the respective lengths from the center C of the object to be heated to the right and left ends of the pressure roller 5 are different.

FIGS. 22A to 22C are schematic diagrams similar to FIGS. 20A to 20C showing the fourteenth embodiment. The end portions of the pressure roller 5 are in contact with the portions of the heater substrate 3 where there are no resistive heat bodies 4. Further, the pressure roller 5 rotates, and its surface is in contact with air while constantly moving at a speed, so that it is easily cooled. Thus, a large quantity of heat is likely to escape from the end portions of the resistive heat bodies 4 to the end portions of the pressure roller 5 through the heater substrate 3. In FIGS. 22A to 22C, assuming that the respective lengths from the center C of the object to be heated to the left and right ends of the pressure roller 5 are c1 and c2, c1<c2.

As in the above-described embodiment, in this case also, heat flows out more easily on the right-hand side, where the pressure roller 5 extends longer. Thus, unless the heat insulating effect due to the depressions 11C1 and 11C2 is made higher in the right end portion than in the left end portion, it is impossible to uniformly impart heat to the object to be heated inside the nip.

Figure 29:
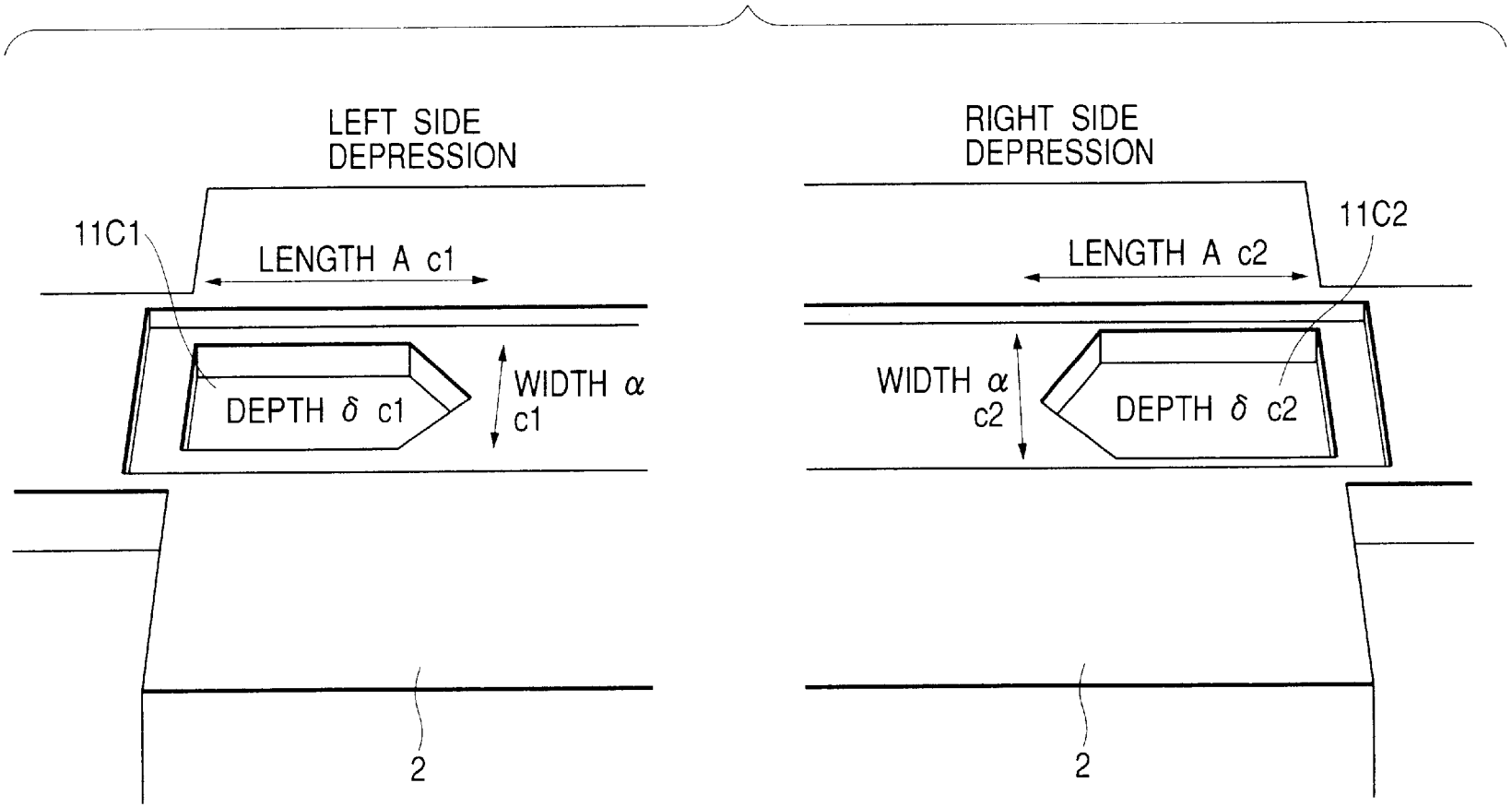
FIG. 29 is an enlarged perspective view of end portions of the stay of FIGS. 22A to 22C.

In order to make the heat insulating effect of the right side depression 11C2 higher than that of the left side depression 11c1, the width of the right side depression is made larger as shown in FIGS. 22 and 29 ($\alpha c1<\alpha c2$). The other dimensions are the same, respectively (length: Ac1=Ac2, depth: $\delta c1=\delta c2$). Due to this arrangement, an increase in area (volume) is achieved, whereby it is possible to prevent flowing-out of heat in the right end portion of the resistive heat bodies 4.

Figures 26A, 26B:
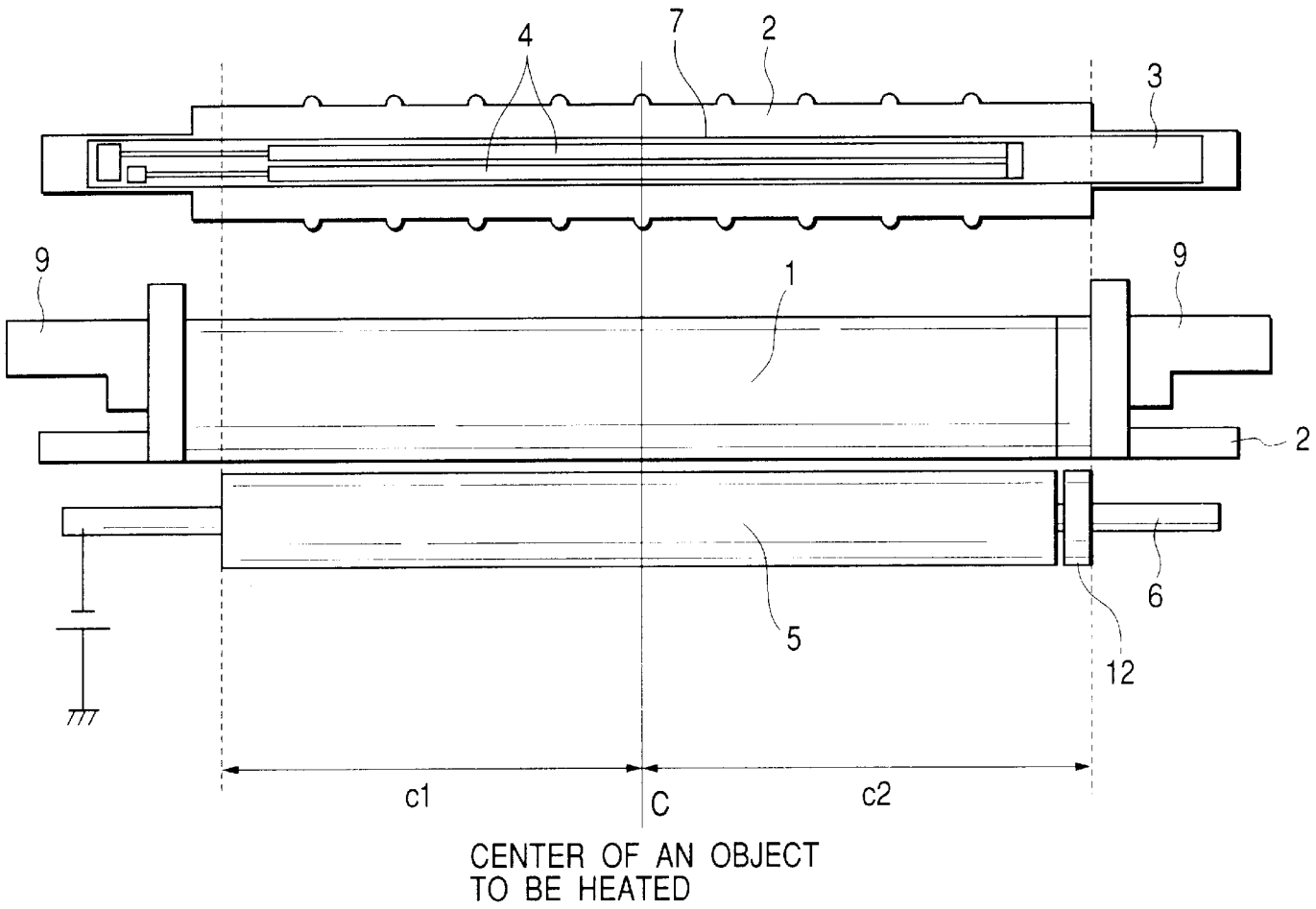
FIGS. 26A and 26B are schematic diagrams showing an example of the case in which a conductive rubber ring is used.

As shown in FIGS. 26A and 26B, when attaching a ring 12 formed of a conductive rubber or the like to an end portion of the pressure roller 5 to apply a bias to the film through a core bar 6 of the pressure roller 5, the ring 12 has substantially the same diameter as the pressure roller 5 and it is to be assumed that heat comes from the film 1 even if it is not in contact with the pressure roller 5. Thus, it is to be regarded as a part of the pressure roller 5. Then, as in this embodiment, in the vicinity of the end portions of the stay 2, the depressions 11 are provided such that there is a difference in heat insulating effect between the right and left sides.

Seventeenth Embodiment

Figures 23A, 23B, 23C:
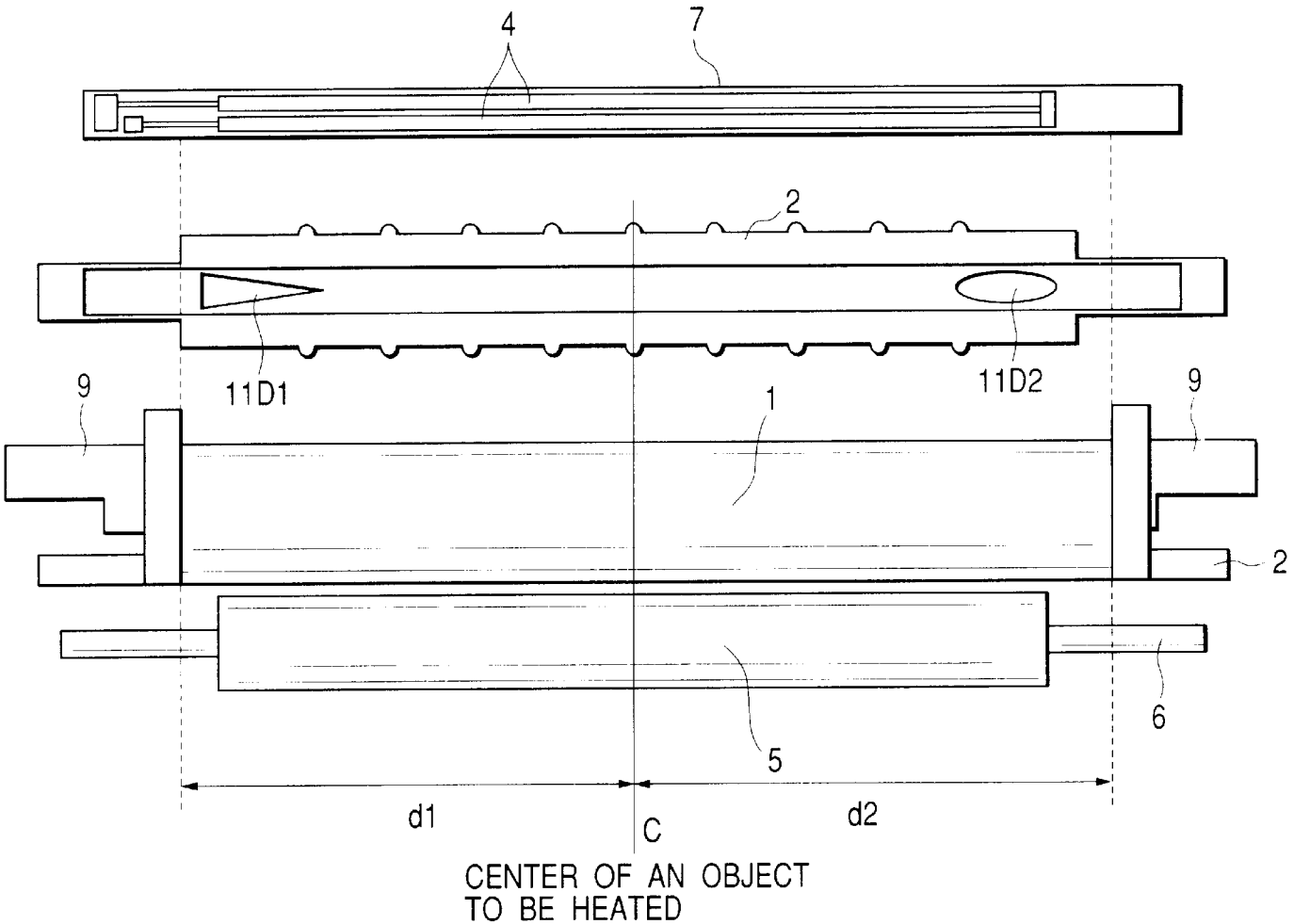
FIGS. 23A, 23B and 23C are schematic diagrams showing a fixing device according to a seventeenth embodiment.

FIGS. 23A to 23C show a seventeenth embodiment in which the respective lengths from the center C of the object to be heated to the right and left ends of the film 1 are different.

FIGS. 23A to 23C are schematic diagram similar to FIGS. 20A to 20C showing the fourteenth embodiment. This construction is adopted when using a flange 9 whose right and left portions are different. The end portions of the film 1 are in contact with the portions of the heater substrate 3 where there are no resistive heat bodies 4. Further, the film 1 rotates, and its surface is in contact with air while constantly moving at a speed, so that it is easily cooled. Thus, a large quantity of heat is likely to escape from the end portions of the resistive heat bodies 4 to the end portions of the film 1 through the heater substrate 3.

In this embodiment, shown in FIGS. 23A to 23C, assuming that the respective lengths from the center C of the object to be heated to the left and right ends are d1 and d2, d1<d2.

In this case, heat is more likely to be taken away in the right end portion of the film 1, and, in the nip inner end portion, the temperature on the right-hand side is lower than in the other portion.

In view of this, as in the above-described embodiments, depressions 11D1 and 11D2 are provided in the vicinity of the end portions of the stay 2 such that the heat insulating effect of the right side depression 11D2 is higher.

Figure 30:
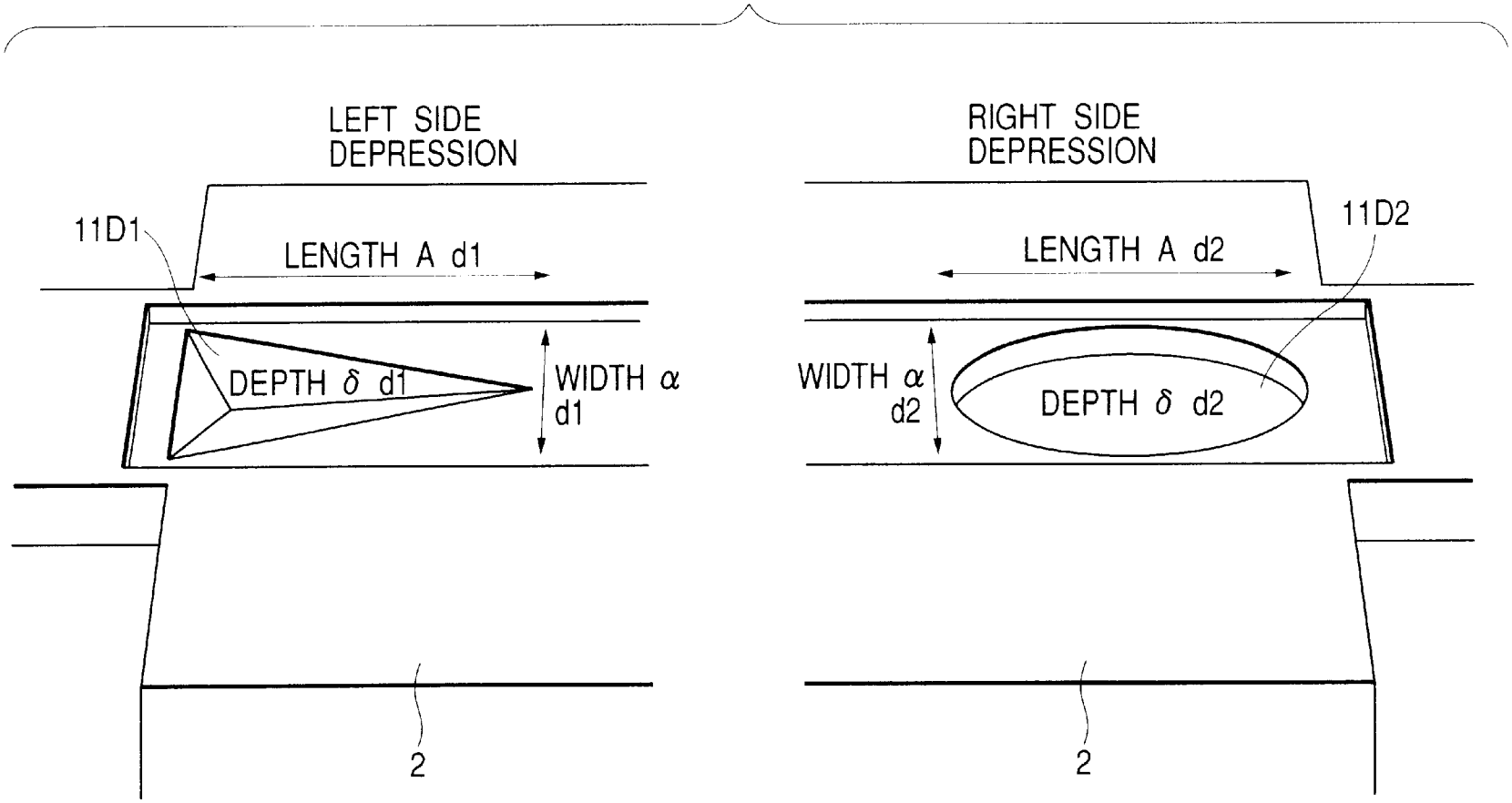
FIG. 30 is an enlarged perspective view of end portions of the stay of FIGS. 23A to 23C.

As shown in FIGS. 23 and 30, in the case of this embodiment, the configurations of the left side and right side depressions 11D1 and 11D2 greatly differ from each other. While the left side and right side depressions 11D1 and 11D2 have the same length, width, and depth (Ad1=Ad2, $\alpha d1=\alpha d2$, $\delta d1=\delta c2$), the left side depression 11D1 has a wedge-like, pointed configuration, whereas the right side depression 11D2 has an elliptical configuration. Due to the difference in configuration between them, the right side depression 11D2 has a larger area and volume, and is in contact with the heater 7 with a smaller area, so that it has a higher heat insulating effect.

Due to this construction, it is possible to prevent heat from escaping from the end portions of the resistive heat bodies 4 in the vicinity of the right end portion of the stay 2, thereby making it possible to uniformly heat the object to be heated inside the nip.

Further, as in the fifth embodiment, the fan 10 is mounted somewhat upstream of the fixing device. FIG. 6 is a conceptual drawing showing the construction as seen from above. Regardless of whether the fan 10 is performing in-take operation or exhaust operation, the ambient temperature is likely to be low on the side nearer to the fan 10 of the fixing device, so that it is to be assumed that heat easily escapes. Thus, even if there is no difference in the way heat escapes between the right and left sides of the fixing device, there is the possibility of the influence of the fan 10 being exerted on one side of the center of the object to be heated. In this case also, by providing, in the vicinity of the end portions of the stay 2 where heat is likely to be taken away by the fan 10, depressions 11 such as those of the above embodiments which make it possible to obtain a higher heat insulating effect at one end than at the other end, it is possible to uniformly impart heat to the object to be heated inside the nip.

While in the above-described embodiments two depressions 11 are provided at either end of the stay 2, it is possible, in some cases, to increase the number of depressions. For example, it is also possible to arrange a number of small depressions 11. Regarding the configuration of the depressions, it is possible to select configurations such that the heat insulating effect due to the depression 11 is higher at the end where heat is more likely to escape from the end portions of the resistive heat bodies 4.

In the above-described embodiments the stay 2 has a recess into which the heater 7 is to be fitted. As the size of the heating apparatus is reduced, the stay 2 also becomes smaller, so that when heat stress is dissipated in the stay 2, there is the danger of a crack being dissipated in the recess. The embodiments of the present invention also help to prevent dissipation of such a crack.

The present invention is not restricted to the above-described embodiments, but covers modifications based on the same technical idea.

What is claimed is:

1. An image heating apparatus comprising:

a heater for heating an image on a recording material, said heater having a heat dissipation resistor;

a backup member for forming a nip cooperating with said heater; and a film nipped between said heater and said backup member, wherein the heat dissipation amount per unit length of said heat dissipation resistor differs between a middle zone in a longitudinal direction of the heater and first and second edge zones adjacent to the middle zone, and wherein the heat dissipation amount per unit length thereof also differs between the first edge zone and the second edge zone; and wherein the end portion of said film on the first edge zone side is further spaced apart from the recording material more in a center of a conveying area than the end portion thereof on the second edge zone side, and wherein the heat dissipation amount per unit length of the first edge zone is larger than that of the second edge zone.

2. An image heating apparatus according to claim 1, wherein the heat dissipation amount per unit length in the first and second edge zones of said heat dissipation resistor is larger than that of the middle zone of said heat dissipation resistor.

3. An image heating apparatus according to claim 1, wherein said apparatus is mounted on an image forming apparatus equipped with a fan, said fan being arranged nearer to the first edge zone than to the second edge zone, and wherein the heat dissipation amount per unit length of the first edge zone is larger than that of the second edge zone.

4. A heater comprising:

a substrate; and a heater dissipation resistor formed on said substrate, wherein the heat dissipation amount per unit length of said heat dissipation resistor differs between a middle zone in a longitudinal direction of the heater and first and second edge zones adjacent to the middle zone, and wherein the heat dissipation amount per unit length thereof also differs between the first edge zone and the second edge zone; and wherein the heat conductivity of said substrate is 50 to 150 [W/mk·K].

5. An image heating apparatus comprising:

a heater for heating an image on a recording material, said heater having a heat dissipation resistor;

a backup member for forming a nip cooperating with said heater; and a film nipped between said heater and said backup member, wherein the heat dissipation amount per unit length of said heat dissipation resistor is uniform in the longitudinal direction, and wherein said heat dissipation resistor has a middle zone in a longitudinal direction of the heater and left and right zones adjacent to the middle zone, the left and right zones having different lengths with respect to the recording material in a center of conveying area, and wherein the end portion of said film on the right zone side is further spaced apart from a conveyance reference for the recording material than the end portion thereof on the left zone side, and wherein the right zone of said resistor is longer than the left zone thereof.

6. An image heating apparatus according to claim 5, wherein said apparatus is mounted on an image forming apparatus equipped with a fan, said fan being arranged nearer to the right zone than to the left zone, and wherein the right zone of said resistor is longer than the left zone thereof.

7. A heater comprising:

a substrate; and a heater dissipation resistor formed on said substrate, wherein the heat dissipation amount per unit length of said heat dissipation resistor is uniform in the longitudinal direction, wherein said heat dissipation resistor has a middle zone in the longitudinal direction of the heater and left and right zones adjacent to the middle zone, the left and right zones having different lengths with respect to the recording material; and wherein the heat conductivity of said substrate is 50 to 150 [W/m·k].

8. An image heating apparatus comprising:

a heater for heating an image on a recording material, said heater having a heat dissipation resistor;

a backup member for forming a nip cooperating with said heater; and a film nipped between said heater and said backup member, wherein the heat dissipation amount per unit length of said heat dissipation resistor differs between a middle zone in a longitudinal direction of the heater and first and second edge zones adjacent to the middle zone, and wherein the first and second edge zones have different lengths; and wherein an end portion of said film on the first edge zone side is further spaced apart from the according material more in a center of a conveying area than an end portion thereof on the second edge zone side, and wherein the first edge zone is longer than the second edge zone.

9. An image heating apparatus according to claim 8, wherein the heat dissipation amount per unit length in the first and second edge zones of said heat dissipation resistor is larger than that in the middle zone of said heat dissipation resistor.

10. An image heating apparatus according to claim 8, wherein said apparatus is mounted on an image forming apparatus equipped with a fan, said fan being arranged nearer to the first edge zone than to the second edge zone, and wherein the first edge zone is longer than the second edge zone.

11. A heater comprising:

a substrate; and a heat dissipation resistor formed on said substrate, wherein the heat dissipation amount per unit length of said heat dissipation resistor is different between a middle zone in a longitudinal direction of the heater and first and second edge zones adjacent to the middle zone, and wherein the first edge zone and the second edge zone differ in length; and wherein the heat conductivity of said substrate is 50 to 100 [W/m·k].

12. An image heating apparatus comprising:

a heater for heating an image on a recording material, said heater having a heat dissipation resistor;

a supporting member for supporting said heater; and a backup member for forming a nip cooperating with said heater, wherein said supporting member has a heat insulating means at a position corresponding to at least one of first and second edge zones of the heat dissipation resistor. in a longitudinal direction, and wherein said heat insulating means is a depression provided in said supporting member.

13. An image heating apparatus according to claim 12, wherein said heater further includes a substrate for supporting said heat dissipation resistor, wherein the end portion of said substrate on the first edge zone side is further spaced apart from a conveyance reference for the recording material than the end portion thereof on the second edge zone side, and wherein the heat insulating effect of said supporting member on the first edge zone side is higher than that on the second edge zone side.

14. An image heating apparatus according to claim 12, wherein the end portion of said support member on the first edge zone side is further spaced apart from a conveyance reference for the recording material than the end portion thereof on the second edge zone side, and wherein the heat insulating effect of said supporting member on the first edge zone side is higher than that on the second edge zone side.

15. An image heating apparatus according to claim 12, wherein the end portion of said backup member on the first edge zone side is further spaced apart from a conveyance reference for the recording material than the end portion thereof on the second edge zone side, and wherein the heat insulating effect of said supporting member on the first edge zone side is higher than that on the second edge zone side.

16. An image heating apparatus according to claim 12, further comprising a film nipped between said heater and said backup member, wherein the end portion of said film on the first edge zone side is further spaced apart from a conveyance reference for the recording material than the end portion thereof on the second edge zone side, and wherein the heat insulating effect of said supporting member on the first edge zone side is higher than that on the second edge zone side.

17. An image heating apparatus according to claim 12, wherein said apparatus is mounted on an image forming apparatus equipped with a fan, wherein said fan is arranged nearer to the first edge zone than to the second edge zone, and wherein the heat insulating effect of said supporting member on the first edge zone side is higher than that on the second edge zone side.

18. An image heating apparatus according to claim 12, wherein said supporting member has depressions of different configurations in the first edge zone and the second edge zone.

* * * * *

UNITED STATES PATENT AND TRADEMARK OFFICE

CERTIFICATE OF CORRECTION

PATENT NO. : 6,614,004 B2
DATED : September 2, 2003
INVENTOR(S) : Shuji Moriya et al.

It is certified that error appears in the above-identified patent and that said Letters Patent is hereby corrected as shown below:

Title page,
Item [56], References Cited, FOREIGN PATENT DOCUMENTS, "08328416" should read -- 8-328416 --; and "2001244051" should read -- 2001-244051 --.

Signed and Sealed this

Seventeenth Day of February, 2004

JON W. DUDAS
*Acting Director of the United States Patent and Trademark Office*